US006314892B1

(12) United States Patent
Favini

(10) Patent No.: US 6,314,892 B1
(45) Date of Patent: Nov. 13, 2001

(54) FOLDABLE TABLE

(76) Inventor: Peter B. Favini, 107 Connors St., Fitchburg, MA (US) 01420

( * ) Notice: Subject to any disclaimer, the term of this patent is extended or adjusted under 35 U.S.C. 154(b) by 0 days.

(21) Appl. No.: 09/596,263

(22) Filed: Jun. 16, 2000

Related U.S. Application Data

(60) Provisional application No. 60/140,075, filed on Jun. 21, 1999.

(51) Int. Cl.[7] ..... A47B 3/00
(52) U.S. Cl. ..... 108/115; 108/128
(58) Field of Search ..... 108/115, 48, 119, 108/120

(56) References Cited

U.S. PATENT DOCUMENTS 4,099,469 * 7/1978 Sahli ..... 108/115 X
5,205,223 * 4/1993 Ball et al. ..... 108/115 X
5,322,022 * 6/1994 Burkholder ..... 108/48
5,337,657 * 8/1994 Diffrient ..... 108/115
5,927,214 * 7/1999 Schwartz et al. ..... 108/115 X
6,082,838 * 7/2000 Bissu-Palombo ..... 108/115 X

* cited by examiner

*Primary Examiner*—Jose V. Chen
(74) *Attorney, Agent, or Firm*—Pandiscio & Pandiscio

(57) ABSTRACT

A folding table structure is provided which, when unfolded, provides a horizontal or inclined table top surface. The foldable table consists of a table top assembly, a one or two-piece support structure incorporating two rear legs, and two front leg assemblies. The table top assembly and the front leg assemblies are hinged to the support structure. Preferably the front leg assemblies are arranged so as avoid contact with the ground when folded and are retained in the folded position by the weight of the table top assembly. The table parts are assembled in such a way that the table may be folded or unfolded in one relatively fast, relatively low effort motion.

32 Claims, 25 Drawing Sheets

FOLDABLE TABLE

This application claims the benefit of co-pending U.S. Provisional Patent Application No. 60/140,075, filed Jun. 21, 1999.

This invention relates to foldable tables and more particularly to a folding table structure which, when unfolded, provides a horizontal or inclined table top surface.

BACKGROUND OF THE INVENTION

Tables that have foldable legs are well known. Typically they comprise four legs each of which is foldable in the sense that it is movable between a first stored position and a second extended position. Such prior known tables also have means for locking the legs in their extended position.

OBJECTS AND SUMMARY OF THE INVENTION

The primary object of this invention is to provide a table that can be easily folded and unfolded.

Another object is to provide a table which, when folded, has a very thin profile for ease of storage and shipping.

A further object is to provide a table support structure that is very simple and inexpensive to construct and can be adapted so that when it is unfolded, it provides a level or inclined table top.

Still another object is to provide a table support structure design that can be easily adapted for to provide a freestanding table unit or a table that is attached to a wall or other supporting structure.

Another important object is to provide a folding table which can be made lightweight and aesthetically pleasing using a variety of materials.

The foregoing objects are achieved by providing a table comprising a table top assembly, which may be of any shape or complexity dictated by its intended use, a one or two-piece support assembly for supporting the table on a floor or deck or attaching it to a vertical wall or other supporting structure, means for hinging together the table top assembly and the support assembly, two front leg assemblies pivotally attached to the support assembly whereby the two leg assemblies can be pivoted from a folded (i.e., stored) position to an extended position in which they support the table top assembly in a selected raised position, means for causing pivotal movement of the two leg assemblies from their folded to their extended positions, and means for causing pivotal movement of the two leg assemblies from their extended positions back to their folded positions. The front leg assemblies are arranged so as avoid contact with the ground when folded and are retained in the folded position by the weight of the table top assembly. The table parts are assembled in such a way that the table may be folded or unfolded in one relatively fast, relatively low effort motion. When the table top is lifted from vertical to horizontal position, the front leg assemblies automatically swing out until the leading edges of the front leg assemblies are approximately under the front edge of said tabletop assembly. The means for causing pivotal movement of the two leg assemblies from their extended positions back to their folded positions comprise cables that are attached to the two leg assemblies and extend through a hole (or other guide means) forming part of the support assembly. The ends of the cables are gathered together by a lightweight object that is bigger than the hole in the support assembly and serves as a handle. Other features are described or rendered obvious by the following detailed description and the accompanying drawings.

DESCRIPTION OF THE DRAWINGS

In the drawings, like numerals indicate like elements.

DETAILED DESCRIPTION OF THE INVENTION

Referring first to FIGS. 1–14, there is shown a folding table embodying the present invention which, when unfolded, is characterized by an inclined table top. The table shown in FIGS. 1–14 comprises a table top assembly 2, a support or rear assembly 4, and two front leg assemblies 6 and 7.

Figure 4:
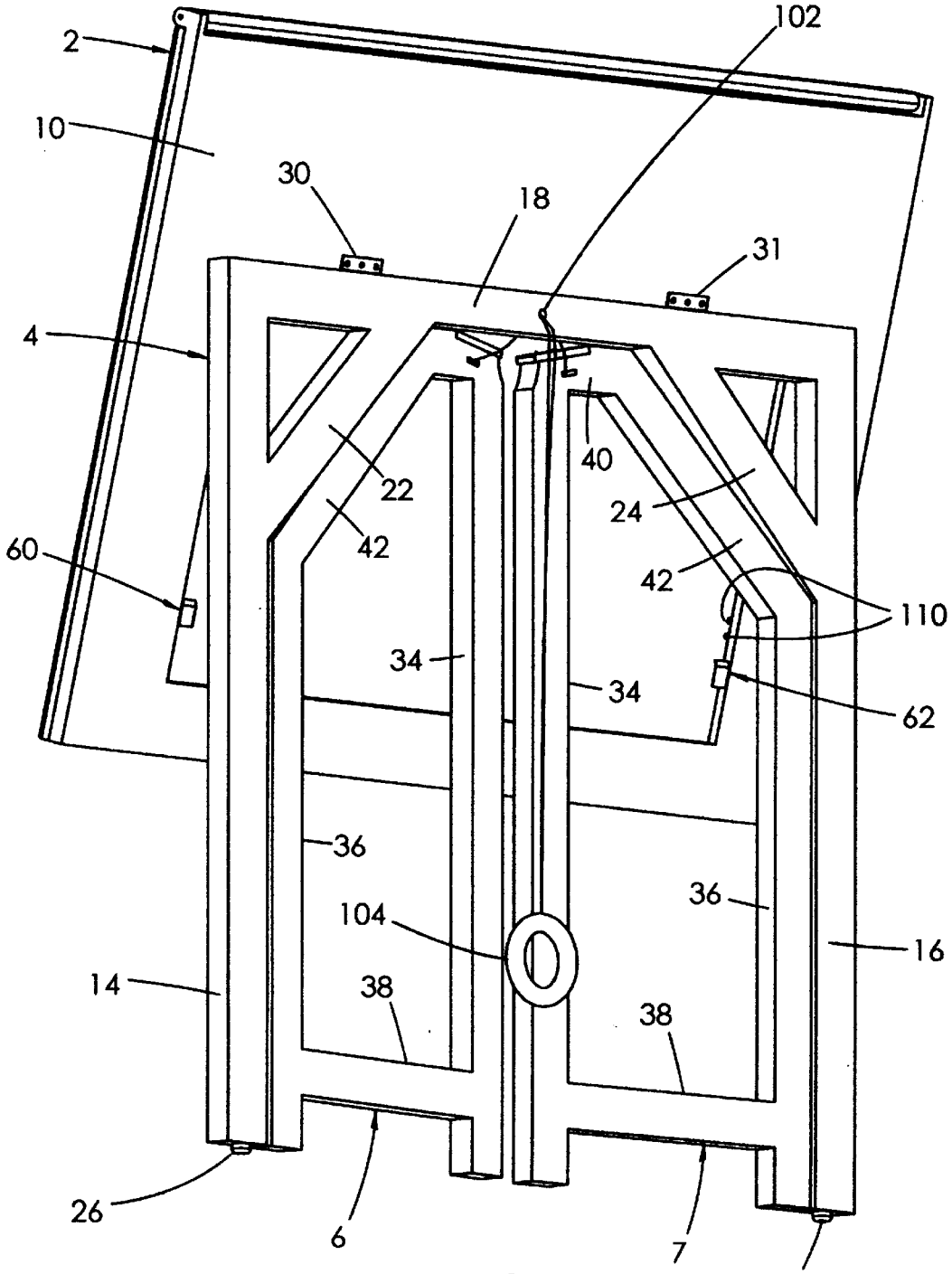
FIG. 4 is an isometric rear view of the table shown in FIG. 3.
Figure 5:
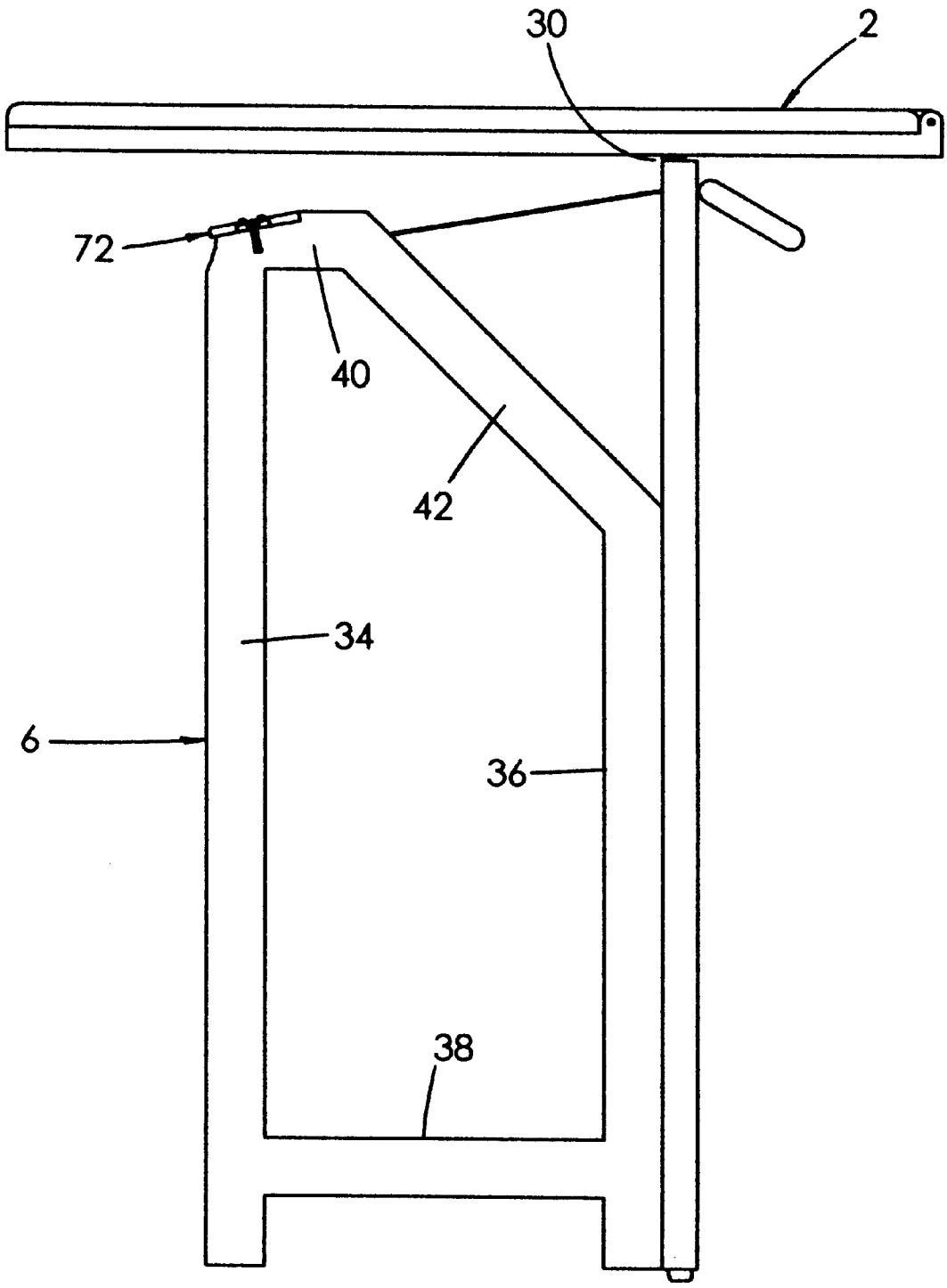
FIG. 5 is a right side view of the same table showing the front leg assemblies in the fully extended position, but before the tabletop assembly is secured to them.
Figure 6:
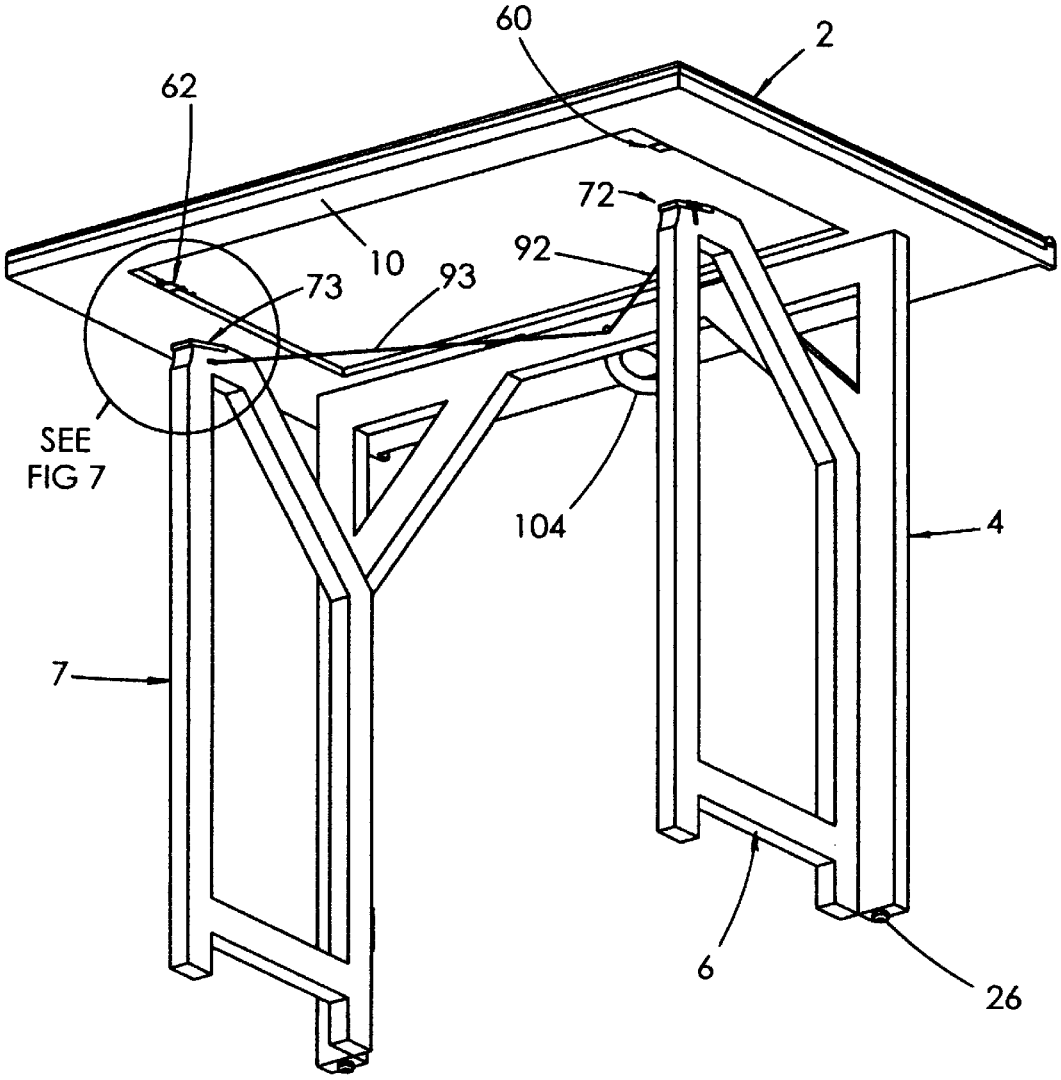
FIGS. 6 & 7 are isometric views of the table shown in FIG. 5.
Figure 7:
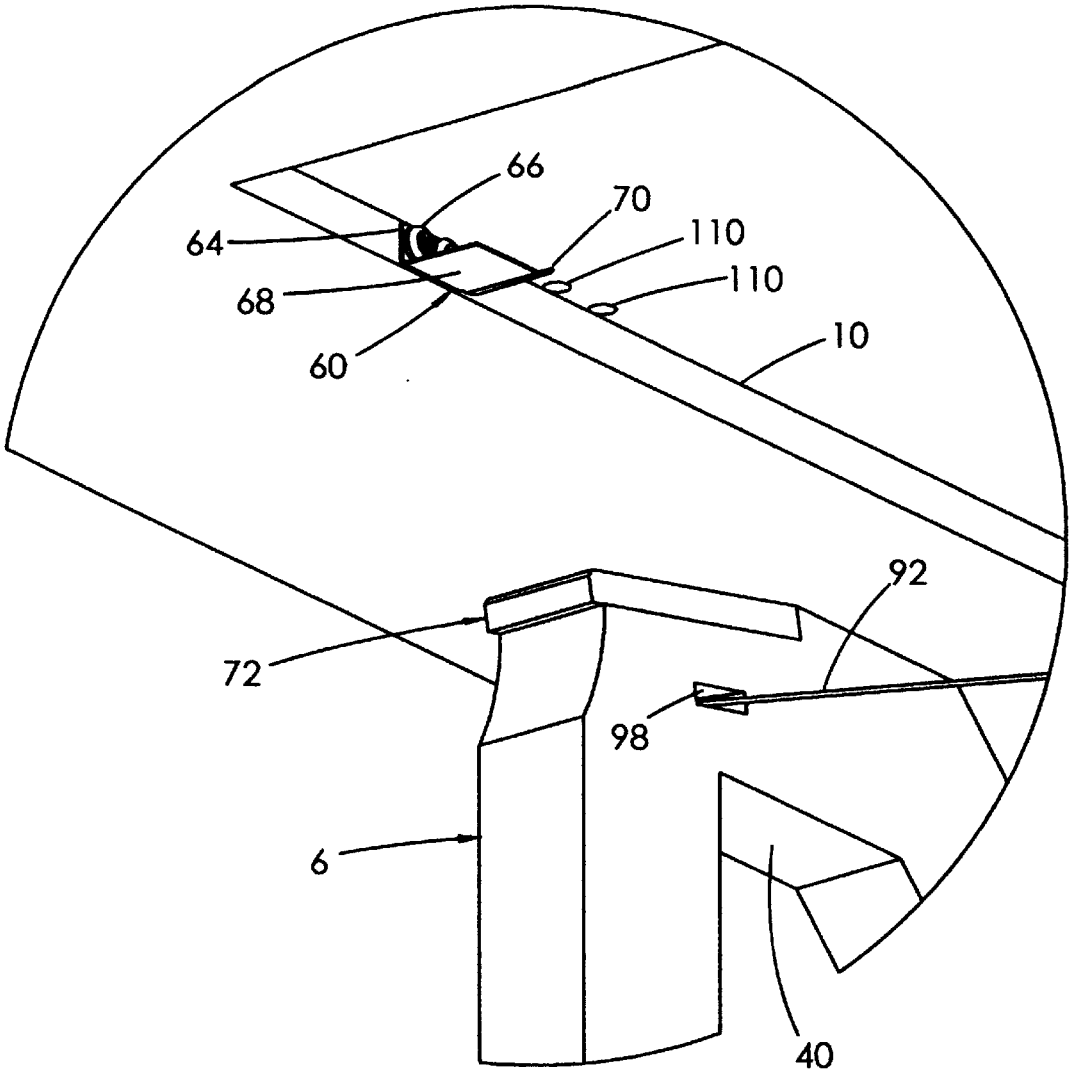

The table top assembly 2 comprises a rectangular frame 10 (FIGS. 4, 6 and 7 and a table top 12 that overlies and is affixed to frame 10. The support assembly 4 is U-shaped, comprising a pair of parallel risers or rear legs 14 and 16 and a header 18 that extends between and is connected to the two risers. Preferably, a pair of angular brace members 22 and 24 extend between and are affixed to risers 14 and 16 and header 18. Preferably the bottom ends of the risers are provided with feet in the form of rounded projections 26. The header is hinged to the table top assembly by hinges 30 and 31 (FIGS. 4, 5, 12 and 13).

Figure 12:
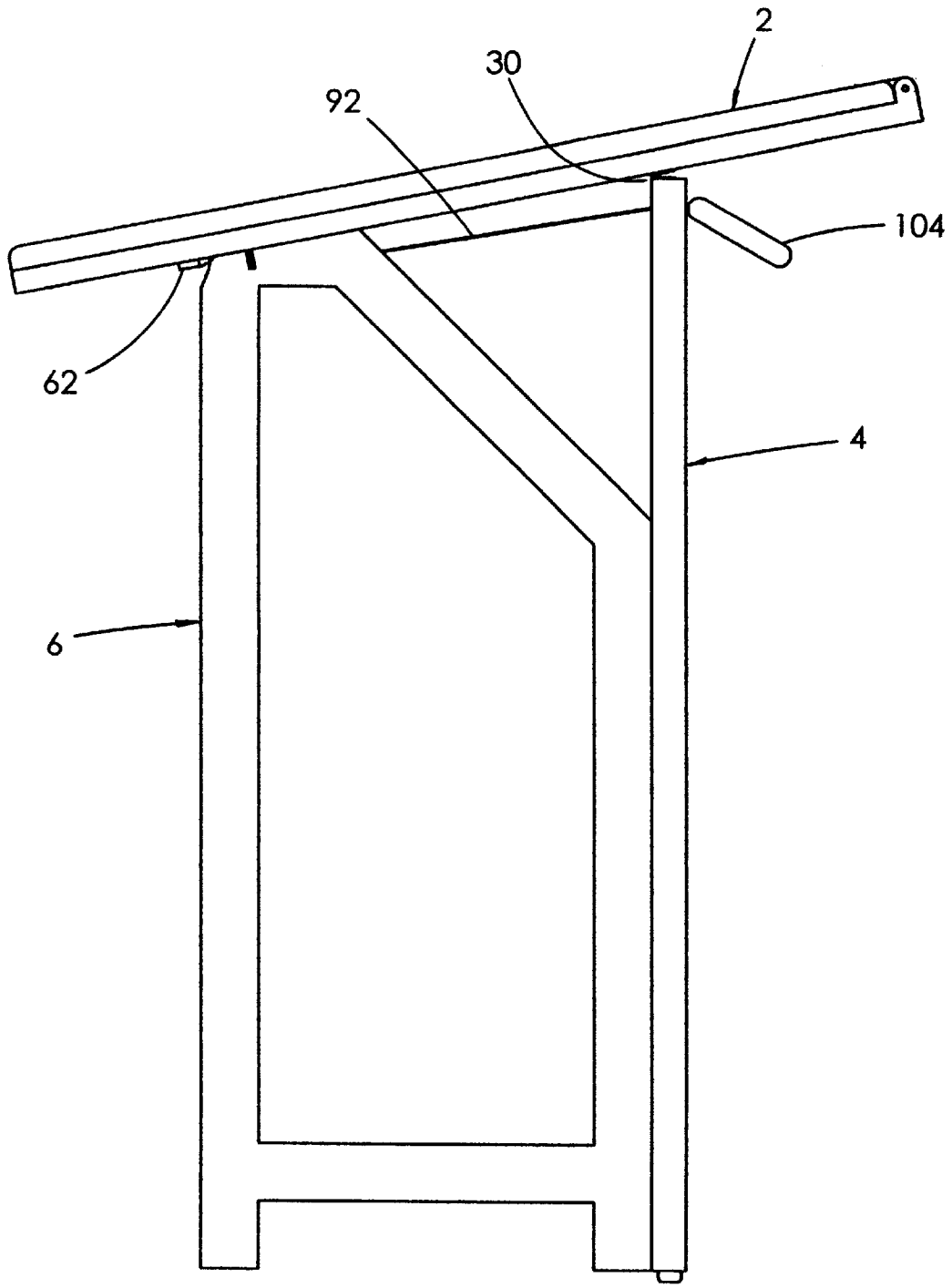
FIG. 12 is a right side view of the table in the unfolded, fully secured position.
Figure 13:
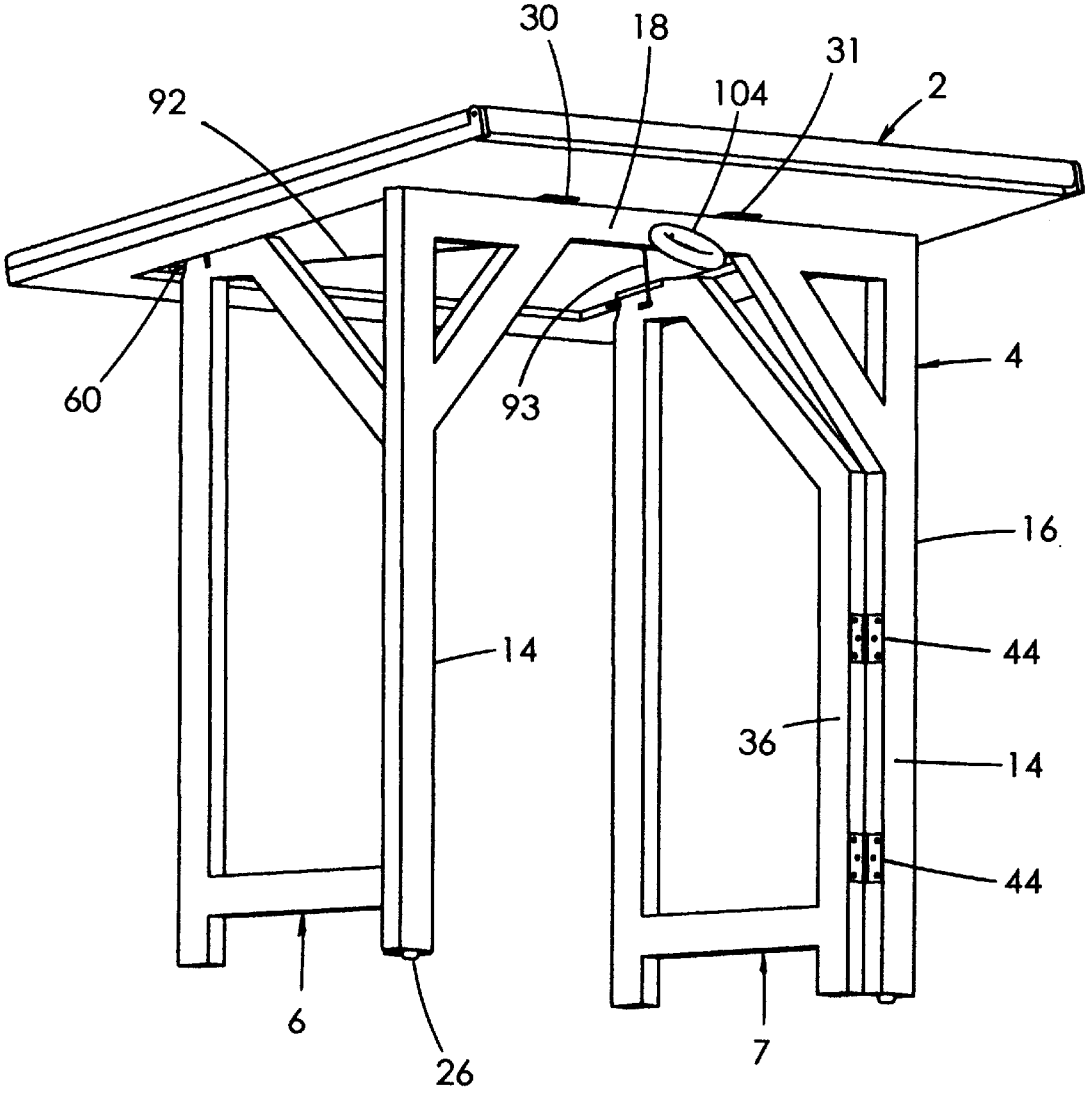
FIG. 13 is an isometric rear view of the table as shown in FIG. 12.
Figure 14:
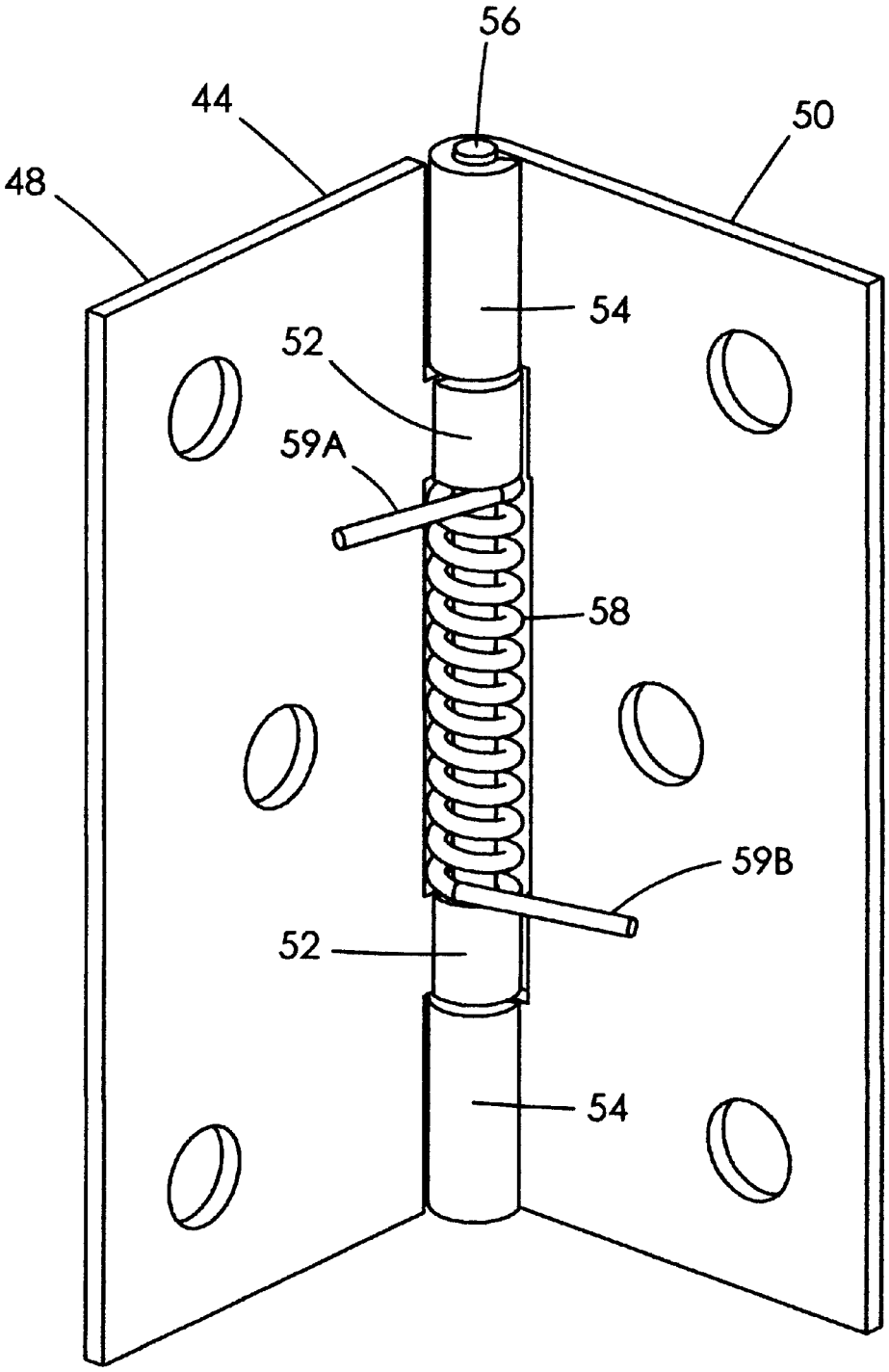
FIG. 14 is an isometric view of a typical spring hinge which could be used to attach the front leg assemblies to the support assembly.
Figure 15:
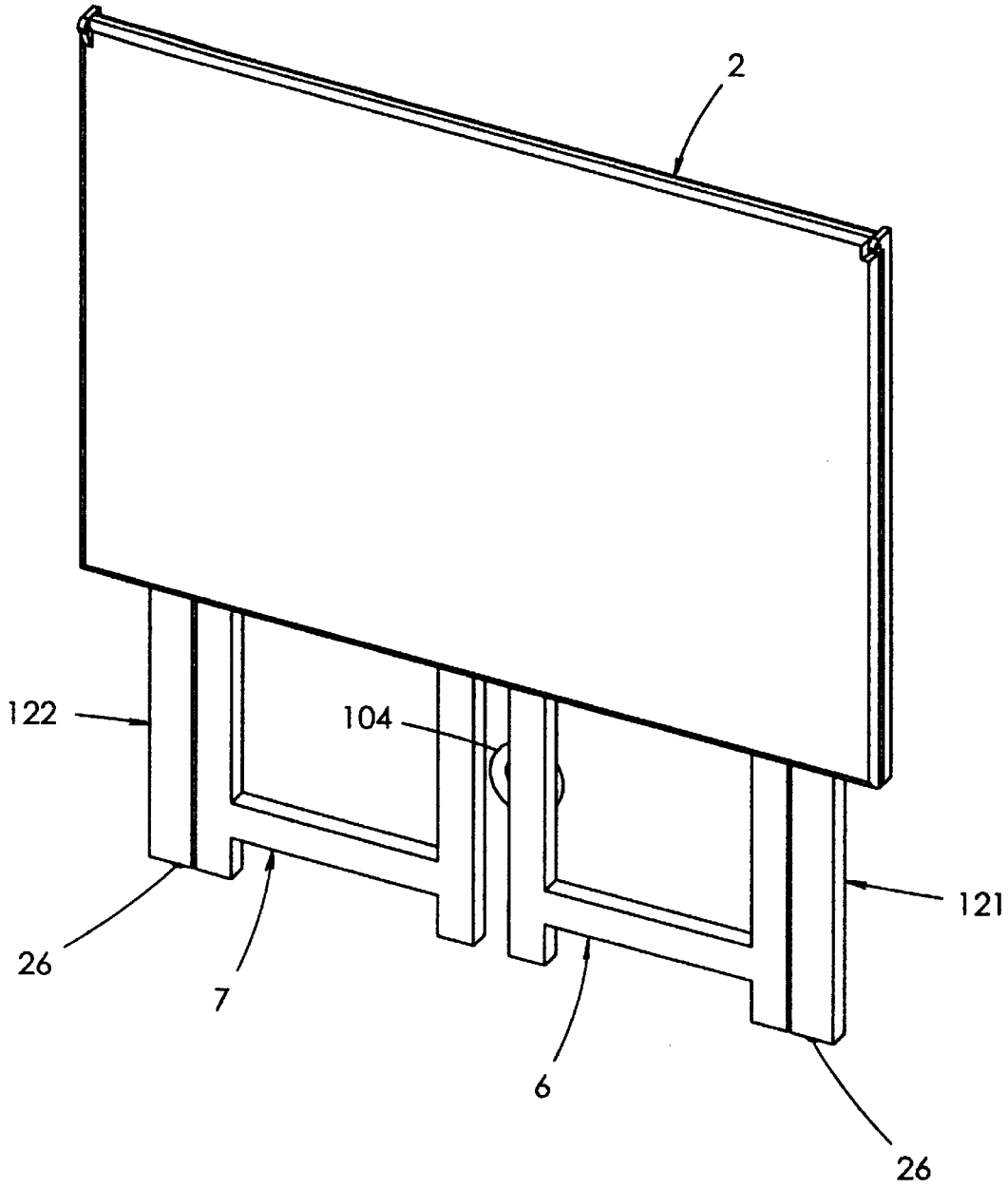
FIG. 15 is a view similar to FIG. 1; it is an isometric front view of an alternative embodiment of the invention in the form of a level top table with a two piece support assembly in the folded position.

As seen best in FIGS. 4–6, 12 and 13, the two leg assemblies 6 and 7 are mirror images of one another. Accordingly, the following description of front leg assembly 6 is to be understood as also describing the other leg assembly 7. Essentially the leg assembly 6 comprises front and rear legs or risers 34 and 36 which are connected adjacent their bottom ends by a horizontal brace or stringer 38. Front and rear leg members 34 and 36 differ in height as shown, and are connected at their top ends by a short horizontally-extending top member or header 40 and an inclined connecting strut 42. The rear leg 36 of the leg assembly 6 is pivotally attached to riser 14 of support assembly 4 by a pair of spring hinges 44 as shown in FIG. 13. FIG. 14 illustrates a preferred form of spring hinge that may be used to attach front leg assemblies 6 and 7 to risers 14 and 16 respectively. It essentially consists of first and second hinge members 48 and 50 that are formed with gudgeons 52 and 54 respectively that are sized to receive a connecting pintle 56. Additionally a coil spring 58 surrounds a portion of the pintle and has one end 59A bearing against hinge member 48 and the other end 59B bearing against hinge member 50. As viewed in FIG. 14, the spring acts to urge the hinge member 48 to pivot clockwise relative to hinge member 50.

Referring to FIGS. 4, 6, 7 and 10, attached to the table top frame 10 adjacent the front end of the table top are two similar spring clips 60 and 62. As seen best in FIGS. 7 and 10, the spring clip 60 is L-shaped in cross-section, comprising a short portion 64 which is attached to the inner edge of the table top frame by suitable screws as shown at 66, and a relative long portion 68 which extends at a right angle to portion 64 and parallel to the flat table top. One end of the longer portion 68 is formed with a curved flange extension 70. Although not shown in detail in the drawings, spring clip 62 is identical to spring clip 60 except that it is formed with its curved flange extension shaped like flange extension 70 but facing in the opposite direction toward clip 60.

Figure 8:
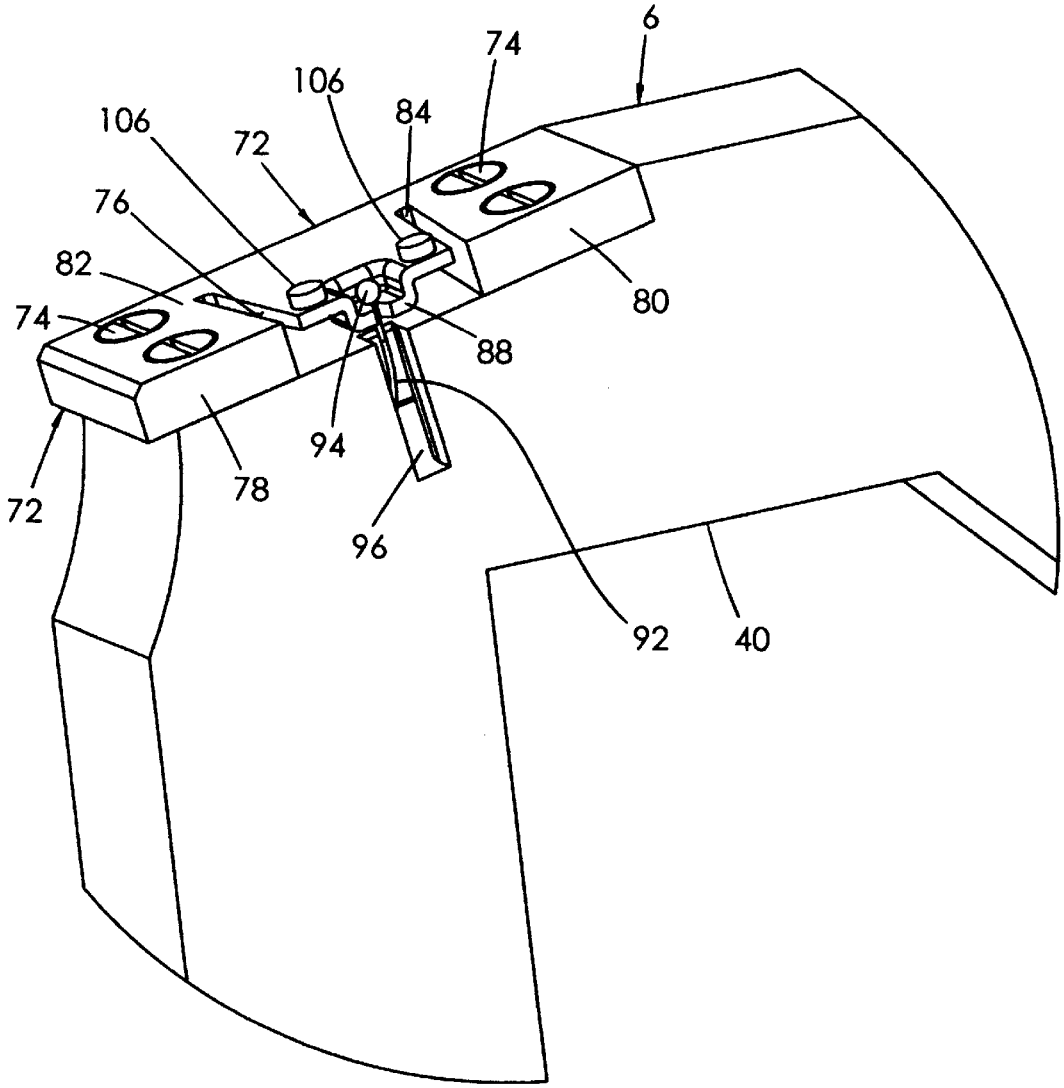
FIG. 8 is an isometric view showing the front leg assembly with a lock mechanism and its operating cord.
Figure 9:
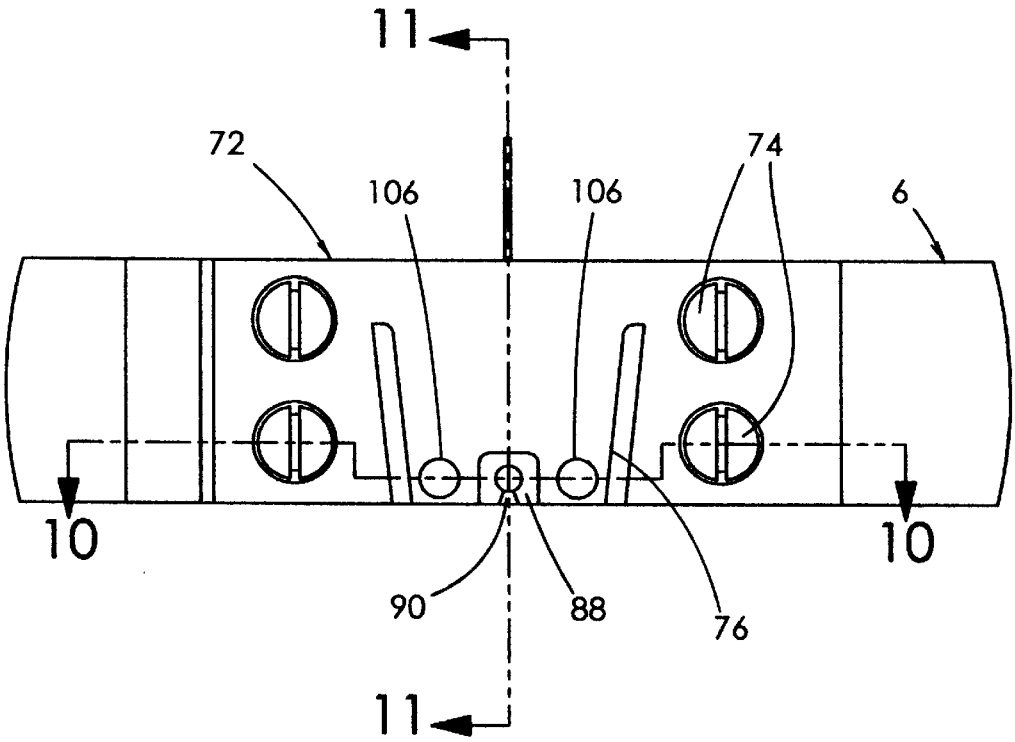
FIG. 9 is a top view of the structure shown in FIG. 8.
Figure 10:
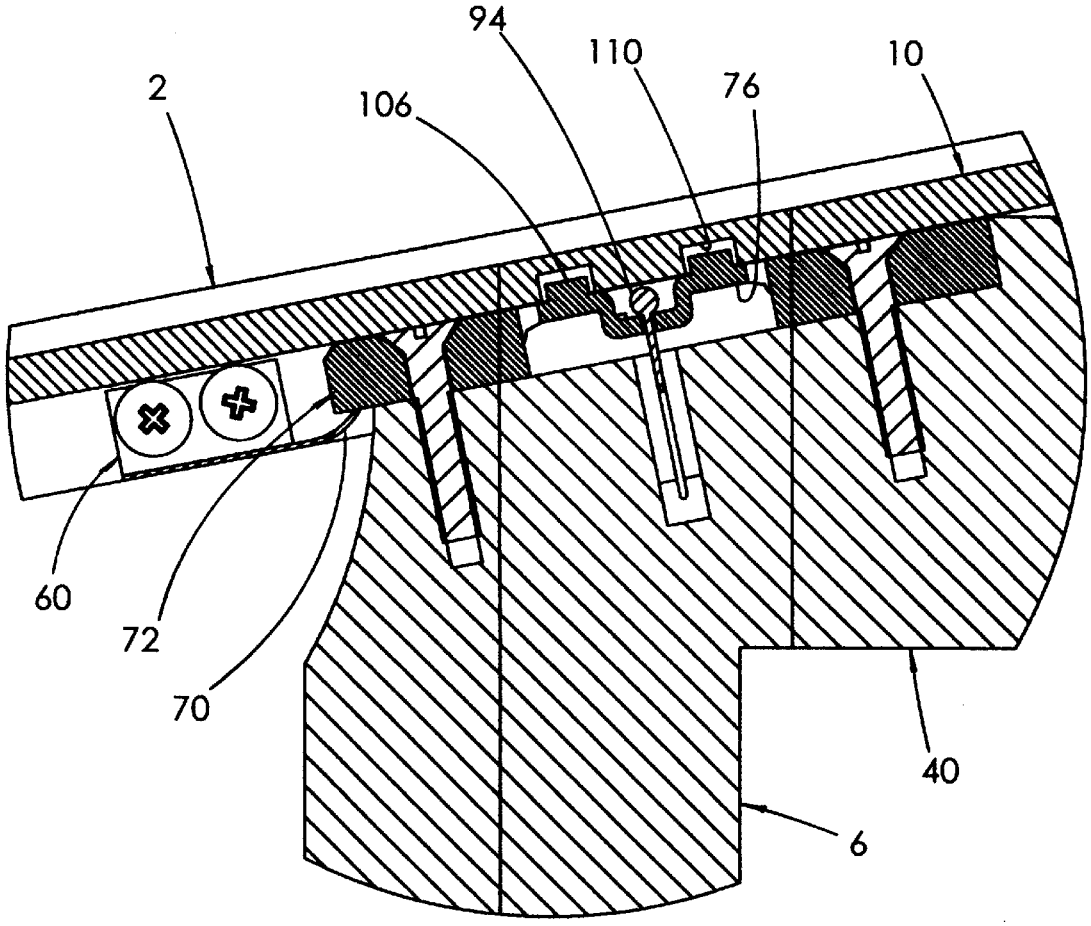
FIG. 10 is a sectional view through the attached tabletop and leg assemblies taken along line 10—10 of FIG. 9.

The spring clips 60 and 62 are provided for engagement with identical pads 72 and 73 which are attached to the upper sides of top members 40 of the two front leg assemblies 6 and 7. Referring now specifically to FIGS. 6–8, the top members 40 of the two leg assemblies are notched to accommodate the pads 72 and 73. The pads are secured to the front leg assemblies by means of suitable fasteners 74. As seen in FIGS. 5–8, the pads project beyond one end of the top surfaces of top members 40 so that they may be engaged by the curved flanges of clips 60 and 62. The pads are preferably made of metal, but they also could be made of a plastic material provided that the plastic material has the appropriate flexibility and resilience to function in the manner hereinafter described. Referring now to FIGS. 8–10, each of the pads 72 and 73 comprises a thin resilient cantilever blade section 76 which is joined to two relatively thick and stiff block sections 78 and 80 which are connected to one end of blade section 76 by two connecting web sections 82 and 84. The free end of blade section 76 is deformed to provide a depressed section or pocket 88 that has a narrow slot 90 extending back from its free edge. Slot 90 is sized to receive one of two flexible operating cables or cords 92 and 93. The adjacent end of that cable is provided with an enlargement, preferably in the form of a round ball 94 as shown, which is sized larger than the width of slot 90 so as to prevent the cable from being pulled down through the slot.

Figure 11:
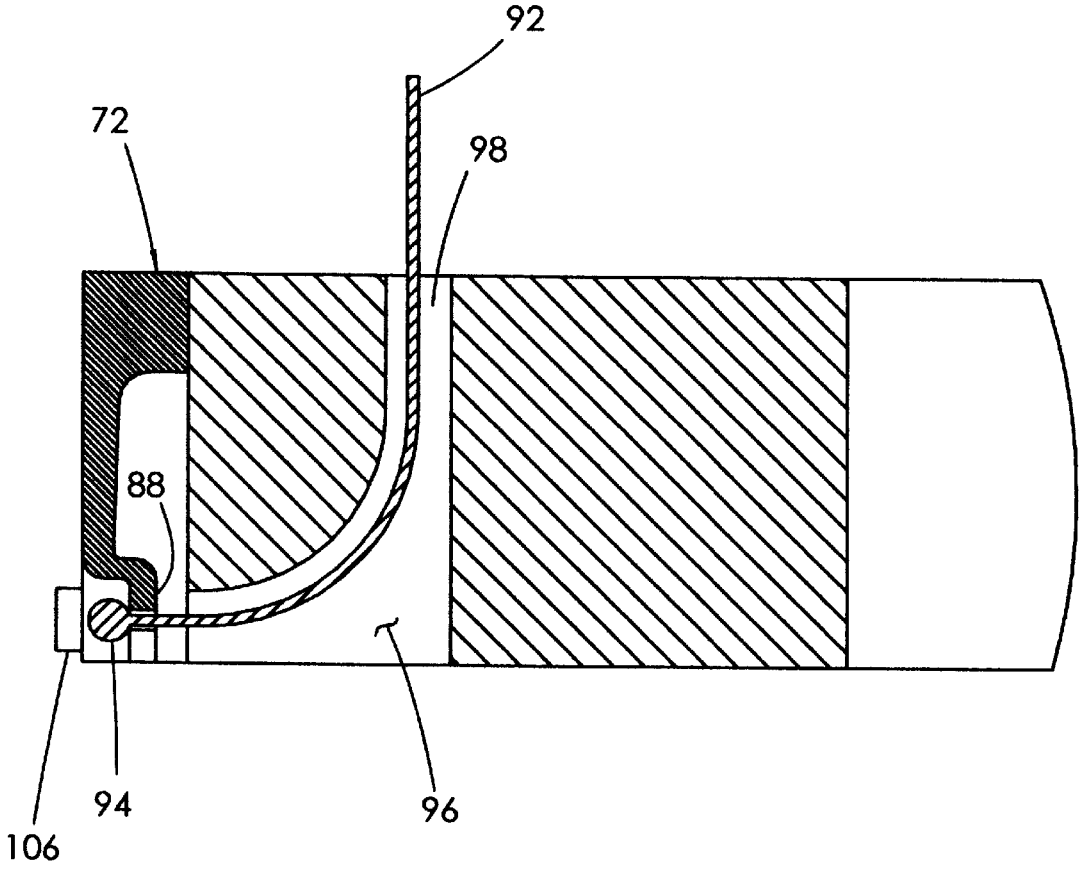
FIG. 11 is a sectional view through the front leg assembly taken along line 11—11 of FIG. 9.

Referring specifically to FIGS. 8, 10 and 11, the top member 40 of each of the front leg assemblies has a notch or recess 96 on its outer side that intersects the top surface of that top member. Notch 96 connects with a hole 98 that passes completely through top member 40. The cable 92 extends through notch 96 and out through hole 98. The like cable 93 is connected in the same way to the other front leg assembly 7. Both cables pass through an opening 102 in the header 18 of the rear support assembly 4. The opposite end of each of the cables is connected to a circular handle or ring 104 which is used to facilitate the user pulling on both cables simultaneously when it is desired to unfold the table.

Referring again to FIGS. 8–10, each of the cantilever blade sections of the two pads 72 and 73 is provided on its upper side with a pair or projections 106 of suitable shape, preferably as flat ended cylinders as shown. Additionally, as shown in FIGS. 4, 7 and 10, the underside of the table top is provide with a pair of blind holes 110 adjacent each of the spring clips 60 and 62. The holes 110 are sized and located to receive the projections 106 of pads 72 and 73 when the two leg assemblies are in their extended position and the table top has its clips 60 and 62 engaged with pads 72 and 73.

Figure 1:
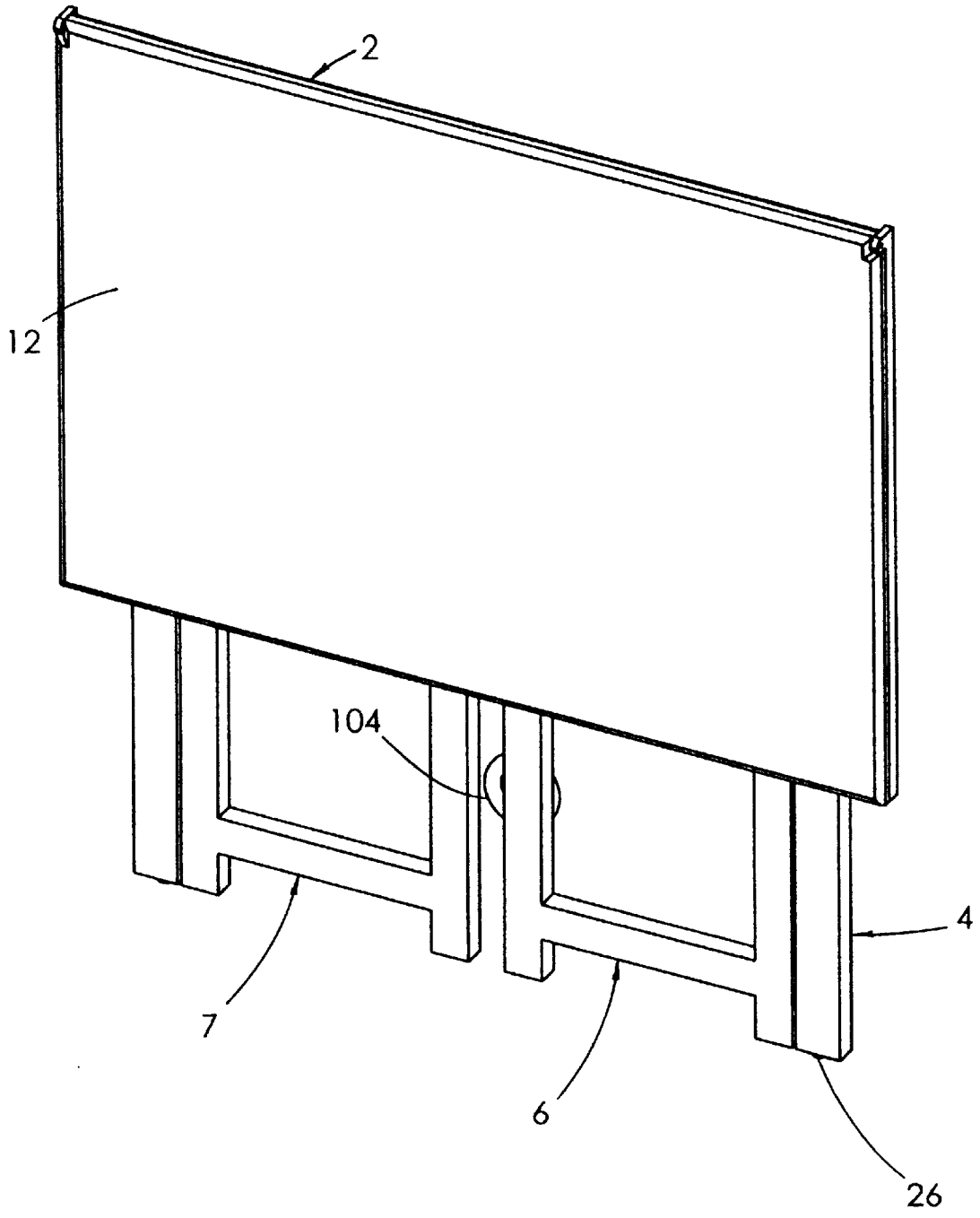
FIG. 1 is an isometric front view of an inclined top table in the folded position constructed according to the invention.
Figure 3:
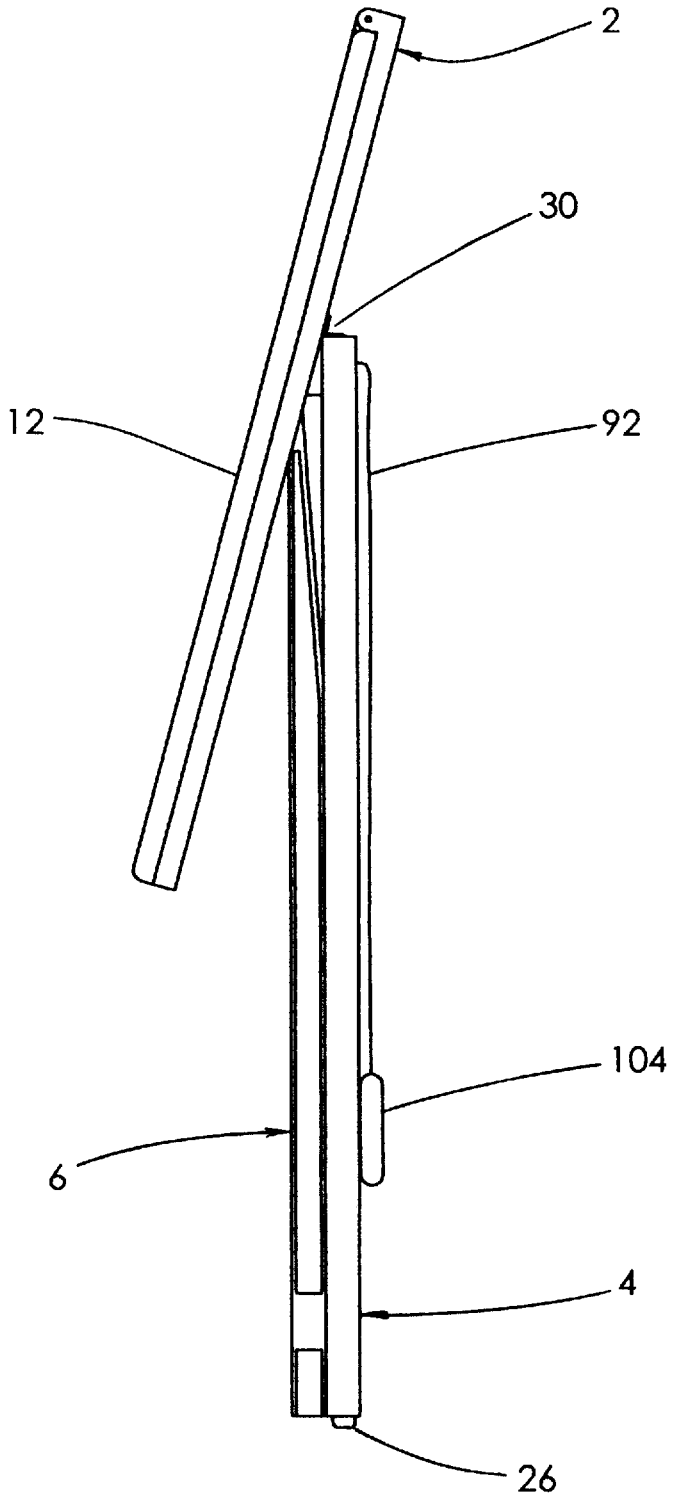
FIG. 3 is a right side view of the same table as it is just beginning to be unfolded.

FIG. 1 shows the table in its folded or collapsed position. In this position, the two front leg assemblies 6 and 7 lie flat against support assembly 4. When it is desired to erect the table, i.e., to unfold it, the user merely has to lift the table top which is lying flat against the front leg assemblies, pivoting it upwardly. As the table top pivots upwardly, the spring hinges 44 cause the front leg assemblies to pivot outwardly away from support assembly 4, so as to extend them to the unfolded position shown in FIGS. 5 and 6. In this connection it is to be observed that FIG. 3 illustrate the table top as it is in the process of being lifted and FIG. 4 also shows the two front leg assemblies in the process of swinging outwardly to their extended positions. The front leg assemblies stop moving to their outward position when the handle 104 engages the rear side of the support assembly and/or the pads 72 and 73 engage the adjacent side sections of the frame 10 of the table top assembly. With the front leg assemblies in their extended positions, the flanges of the spring clips 60 and 62 engage the underside of the projecting end portions of the pads 72 and 73, thereby locking the table in place vertically. Additionally the projections 106 extend into blind holes 110, thereby locking the front leg assemblies against moving horizontally relative to the table top, i.e., locking those leg assemblies against pivoting relative to the back support assembly 4. Since the top members 40 of the front leg assemblies are below the level of the header 18 of the rear support assembly, when the table is in its erected position, the table top assembly is disposed at an inclined angle to the floor or other support on which it is located, as shown in FIG. 12. It is to be noted also that when the extended front leg assemblies are engaged with the floor or other support on which the table is resting, the legs of the front leg assembly and the rear support assembly extend at a slight angle from a true vertical position.

It is to be noted also that when the front leg assemblies are in their retracted or folded position (FIGS. 1–3), their bottom ends are suspended off the ground by the rear support assembly. This is accomplished by appropriately sizing the vertical risers of the front leg assemblies and/or the risers of the rear support assembly, and/or by the addition of the feet 26. Preferably but not necessarily, the feet are made so as to provide a non-slip surface to ease operation when the table top is erected.

Figure 2:
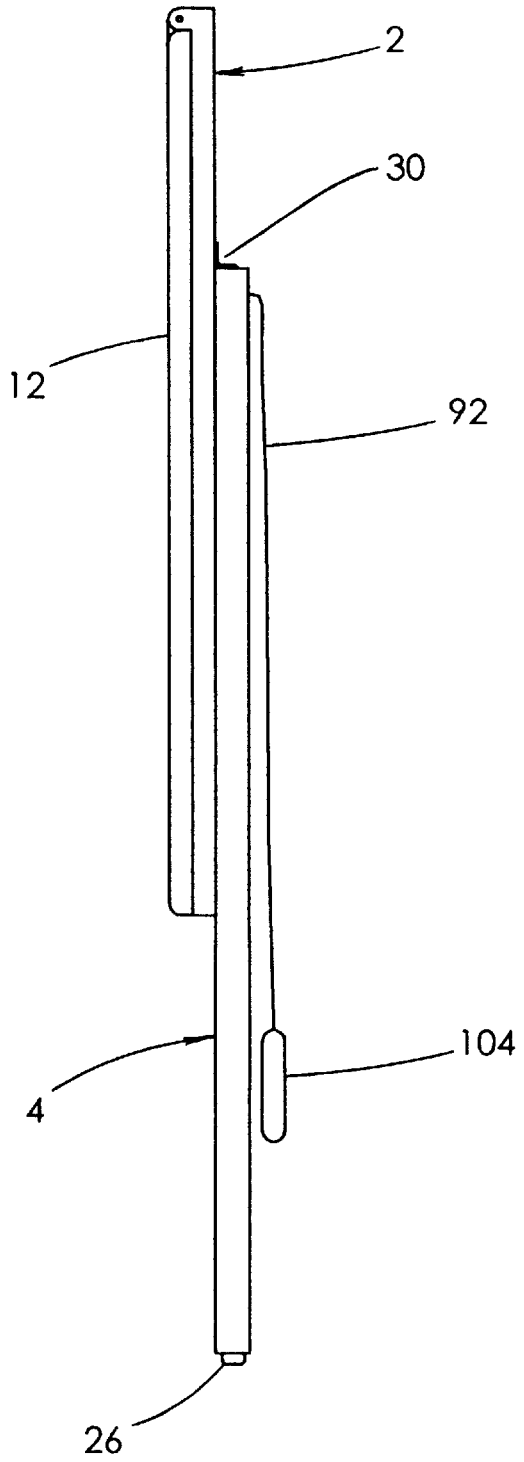
FIG. 2 is a right side view of the table shown in FIG. 1.

When it is desired to fold the table back to the position shown in FIGS. 1–3, the user pulls on the handle of the table top assembly so as to cause the cables to pull down the cantilever blade sections 76 of pads 72 and 73 far enough to cause the projections 106 to clear the holes 110 and to cause the front leg assemblies to pivot back to their original folded (stored) position. As the front leg assemblies pivot back to their folded position, gravity returns the table top assembly to its lowered vertically-extending position. When the table top assembly is in its lowered vertically-extending position, its weight acts to prevent the spring hinges 44 from moving the front leg assemblies out of their folded position back to their extended position.

FIGS. 15–19 show a folding table embodying the present invention which when unfolded features a level table top rather than an inclined table top. This embodiment operates in the same manner as the table illustrated in FIGS. 1–14, except for differences rendered apparent from the drawings and the following description.

Figure 16:
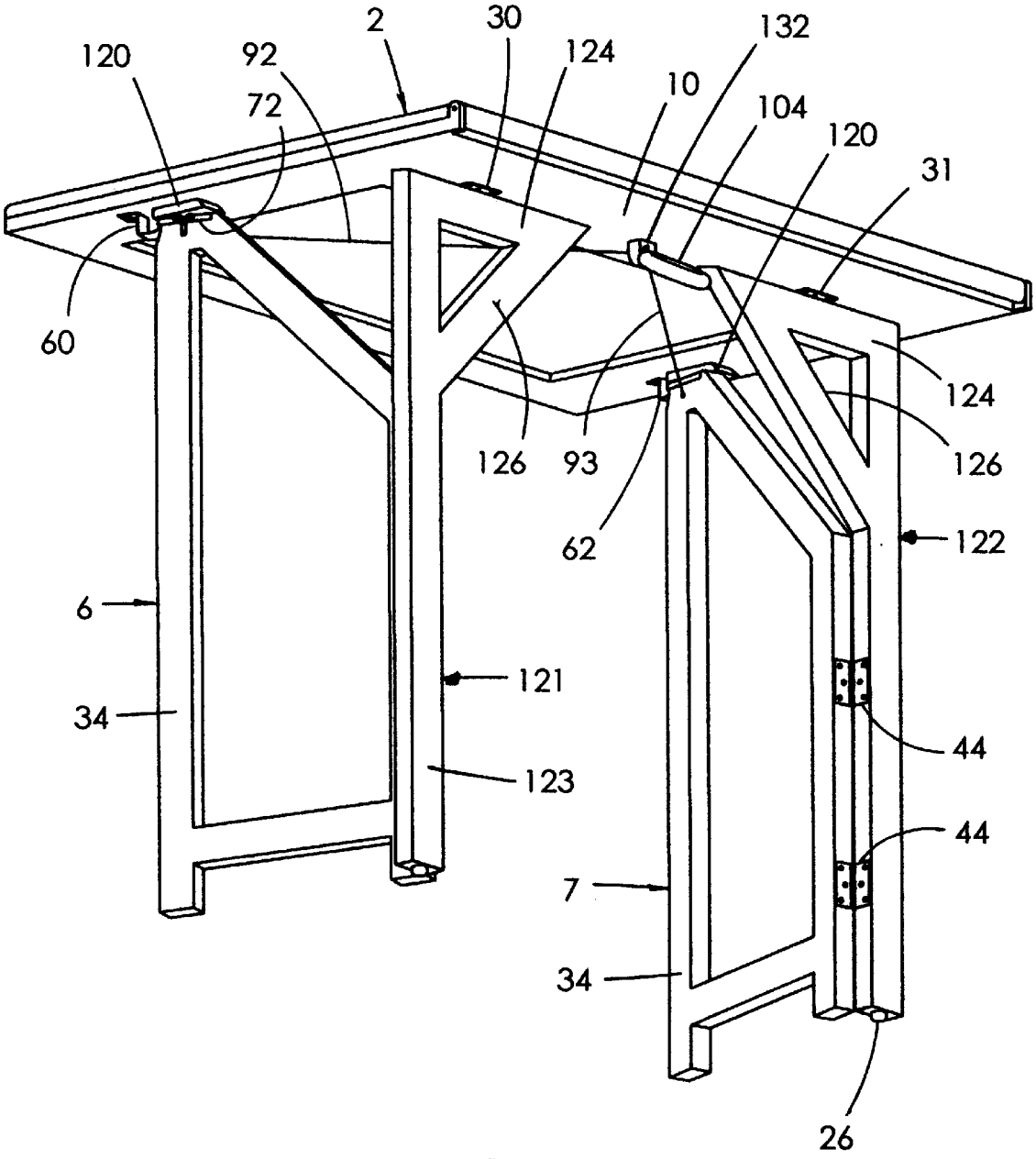
FIG. 16 is an isometric rear view of the table shown in FIG. 15, unfolded and secured.
Figure 17:
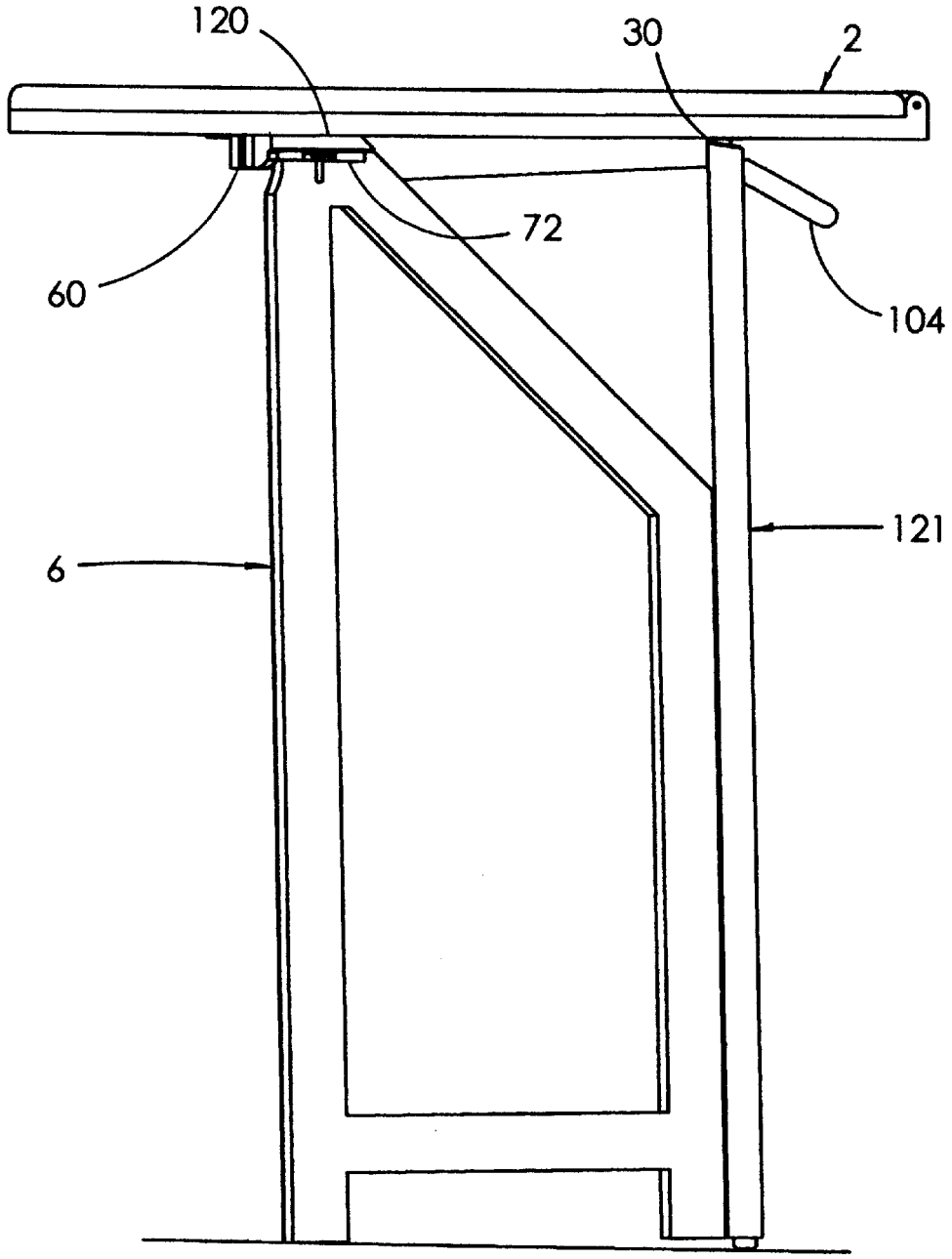
FIG. 17 is right side view of the table shown in FIG. 16.
Figure 18:
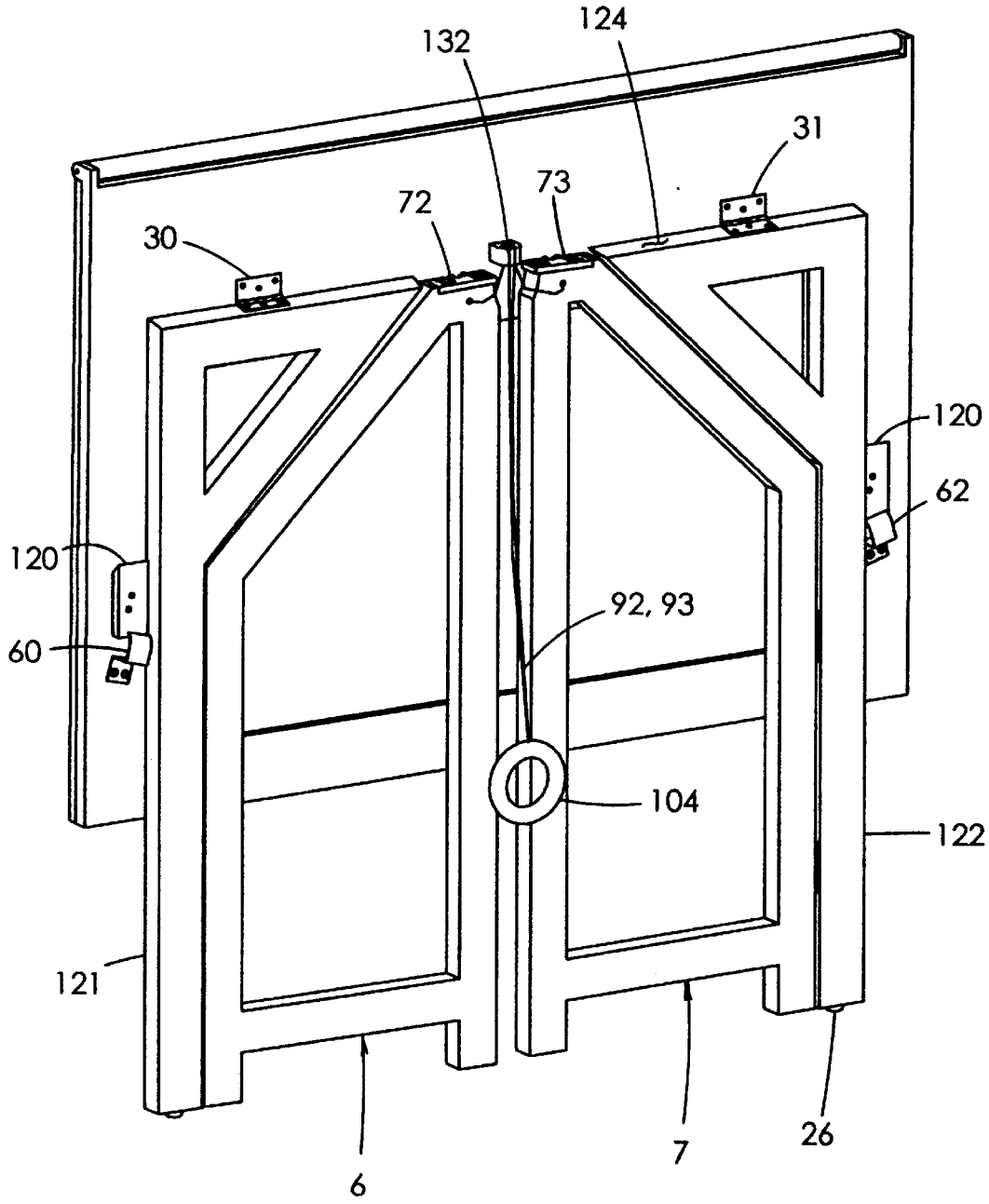
FIG. 18 is an isometric rear view of the table shown in FIGS. 15–17.
Figure 19:
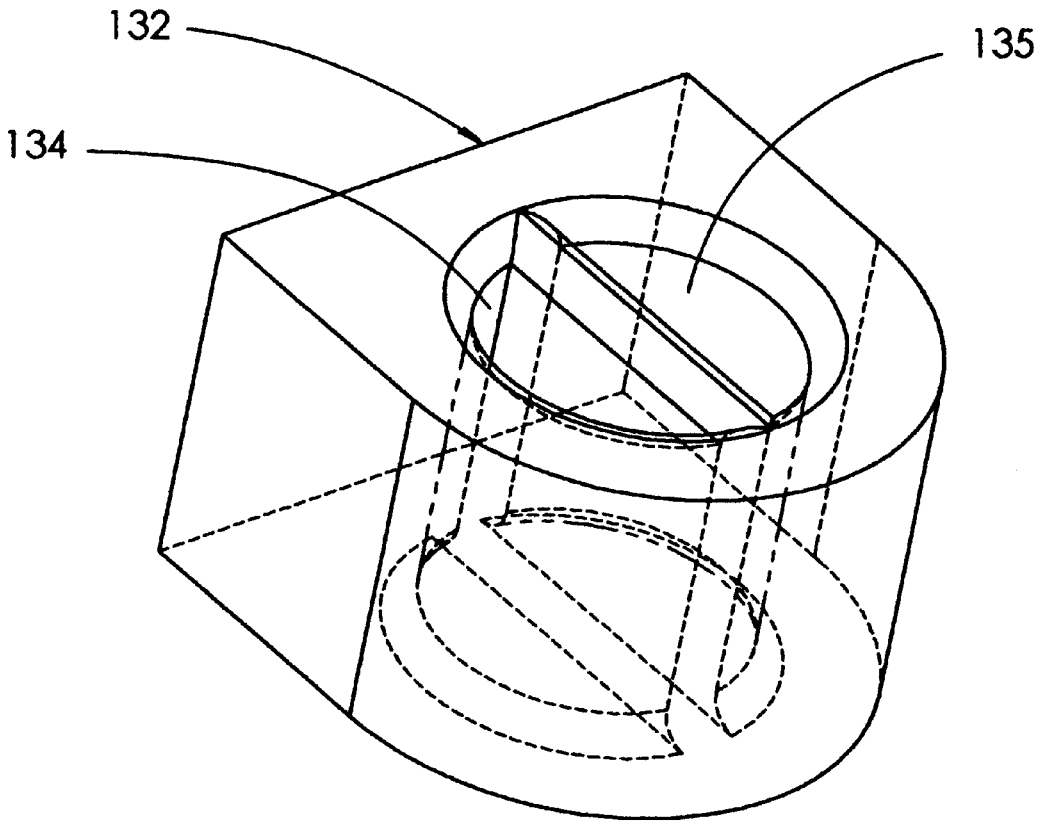
FIG. 19 is an isometric view of the yoke of the table shown in FIGS. 15–18.
Figure 20:
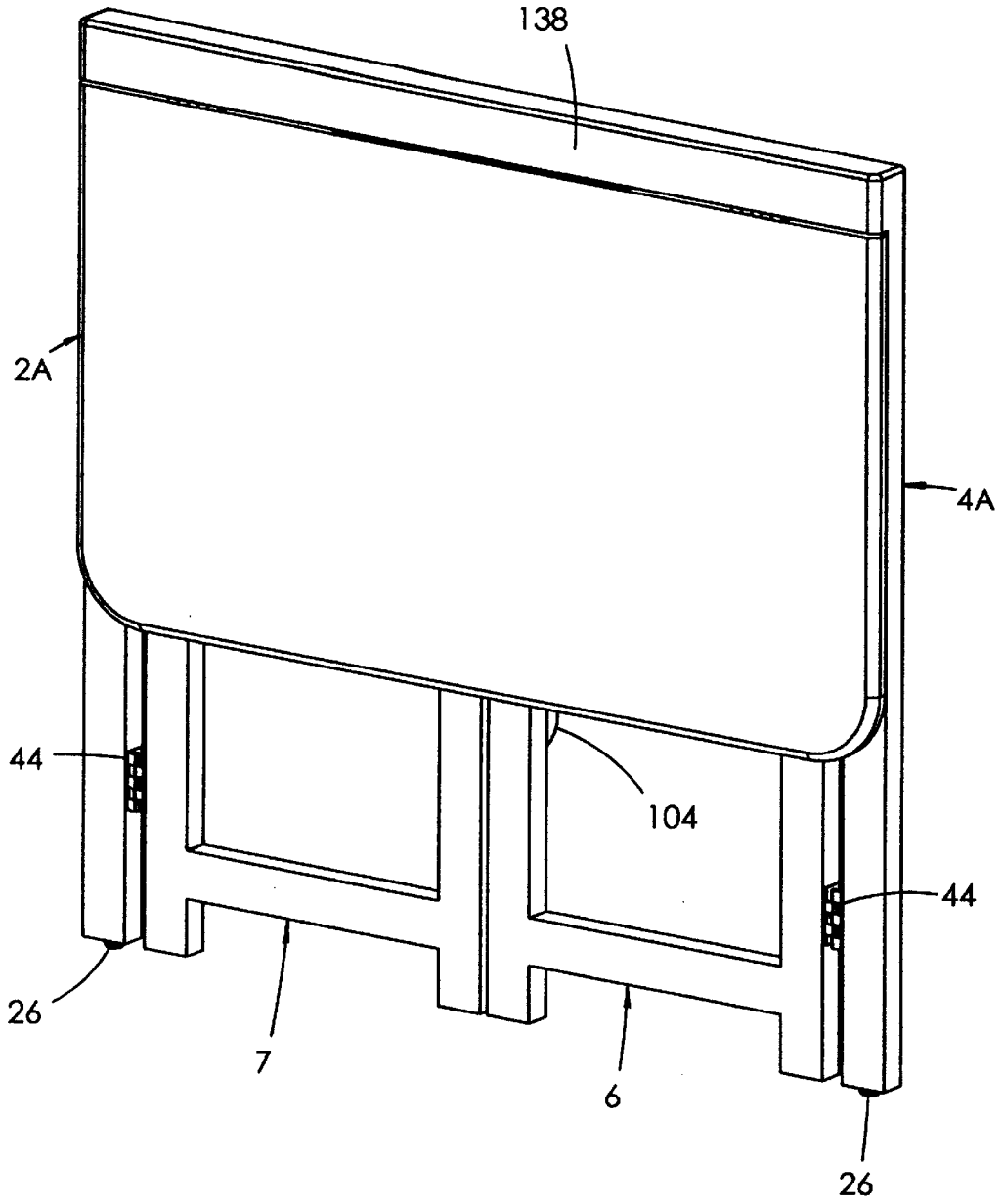
FIG. 20 is a view similar to FIGS. 1 and 15; it is an isometric front view of another embodiment of the invention comprising a level top table with a one piece support assembly.
Figure 21:
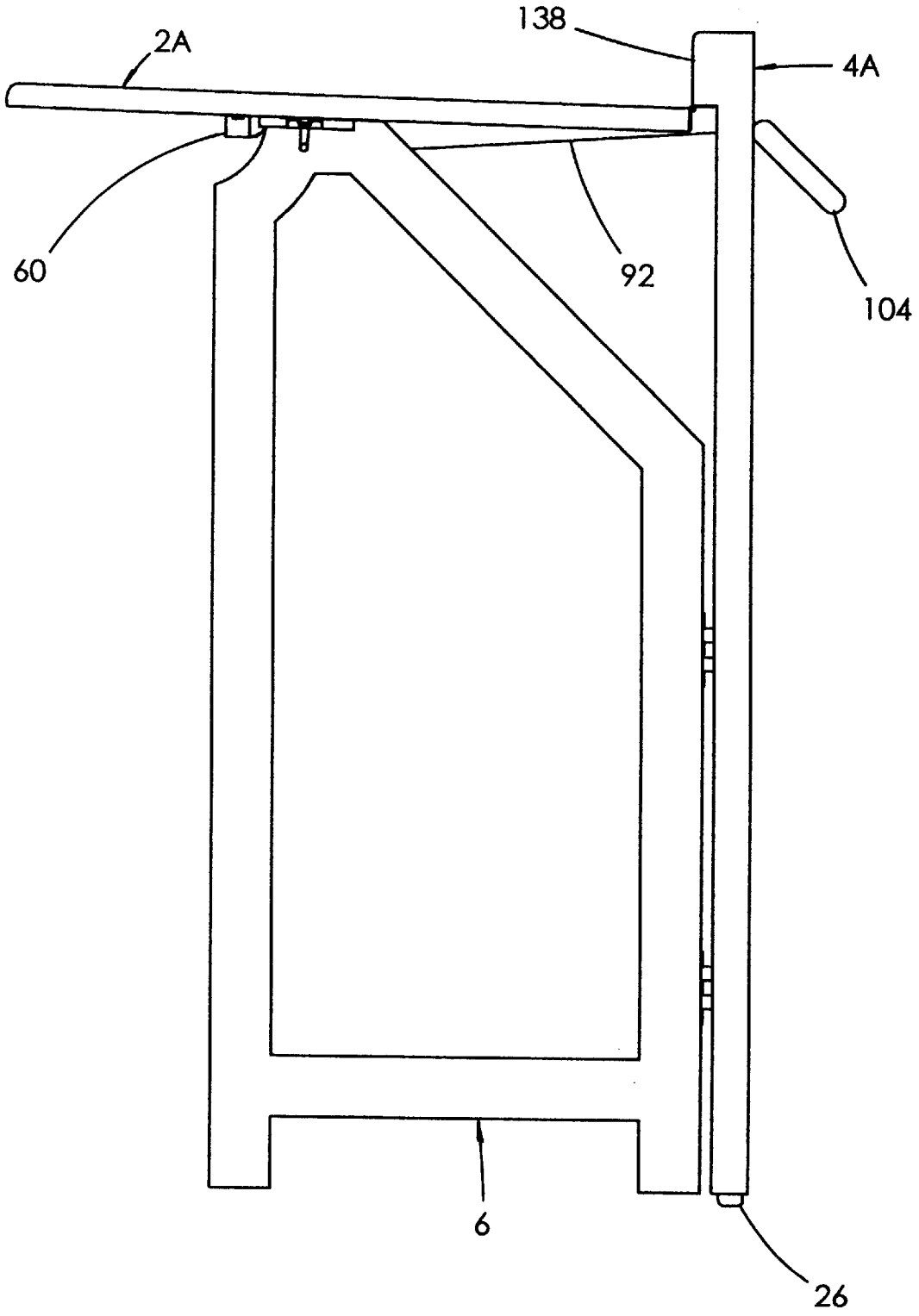
FIG. 21 is a right side view of the table shown in FIG. 20 in the unfolded, fully secured position.
Figure 22:
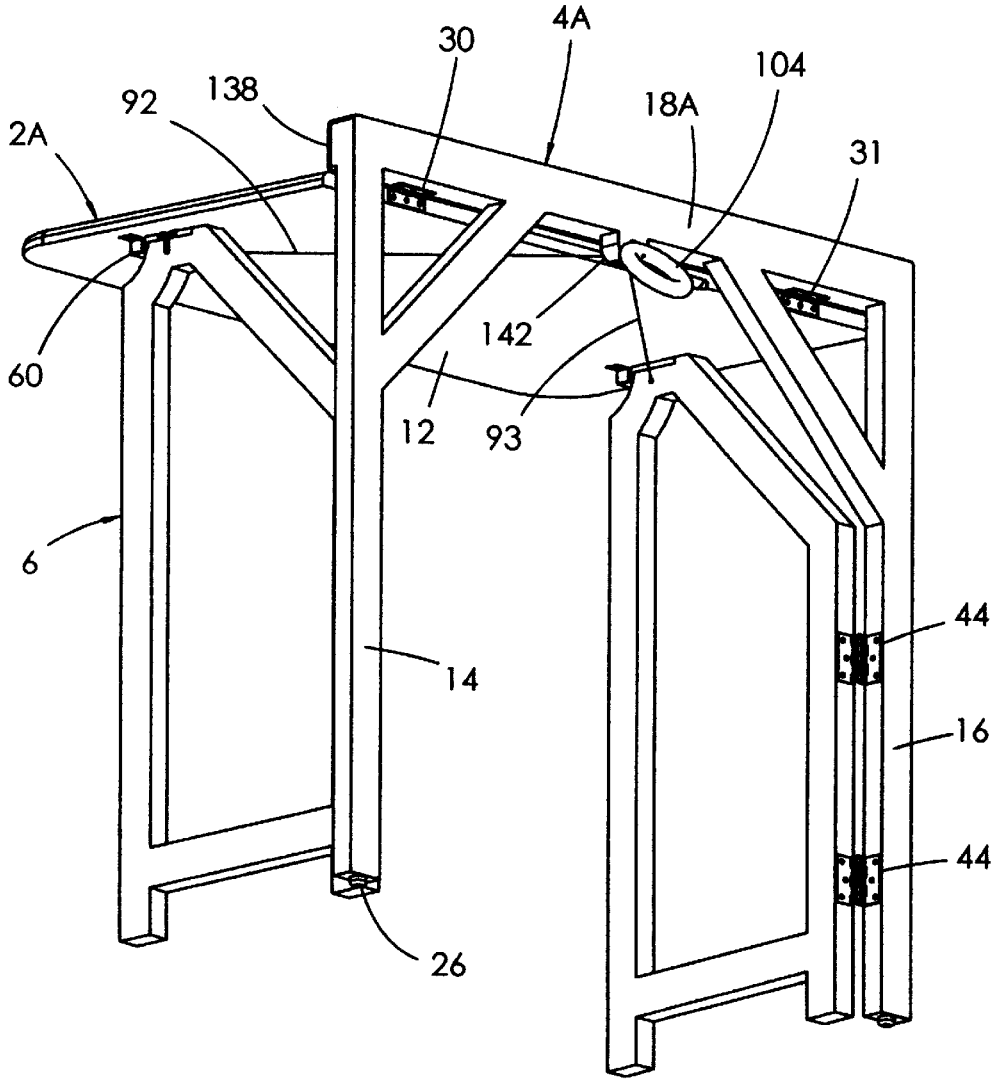
FIG. 22 is an isometric rear view of the table shown in FIGS. 20 and 21.
Figure 23:
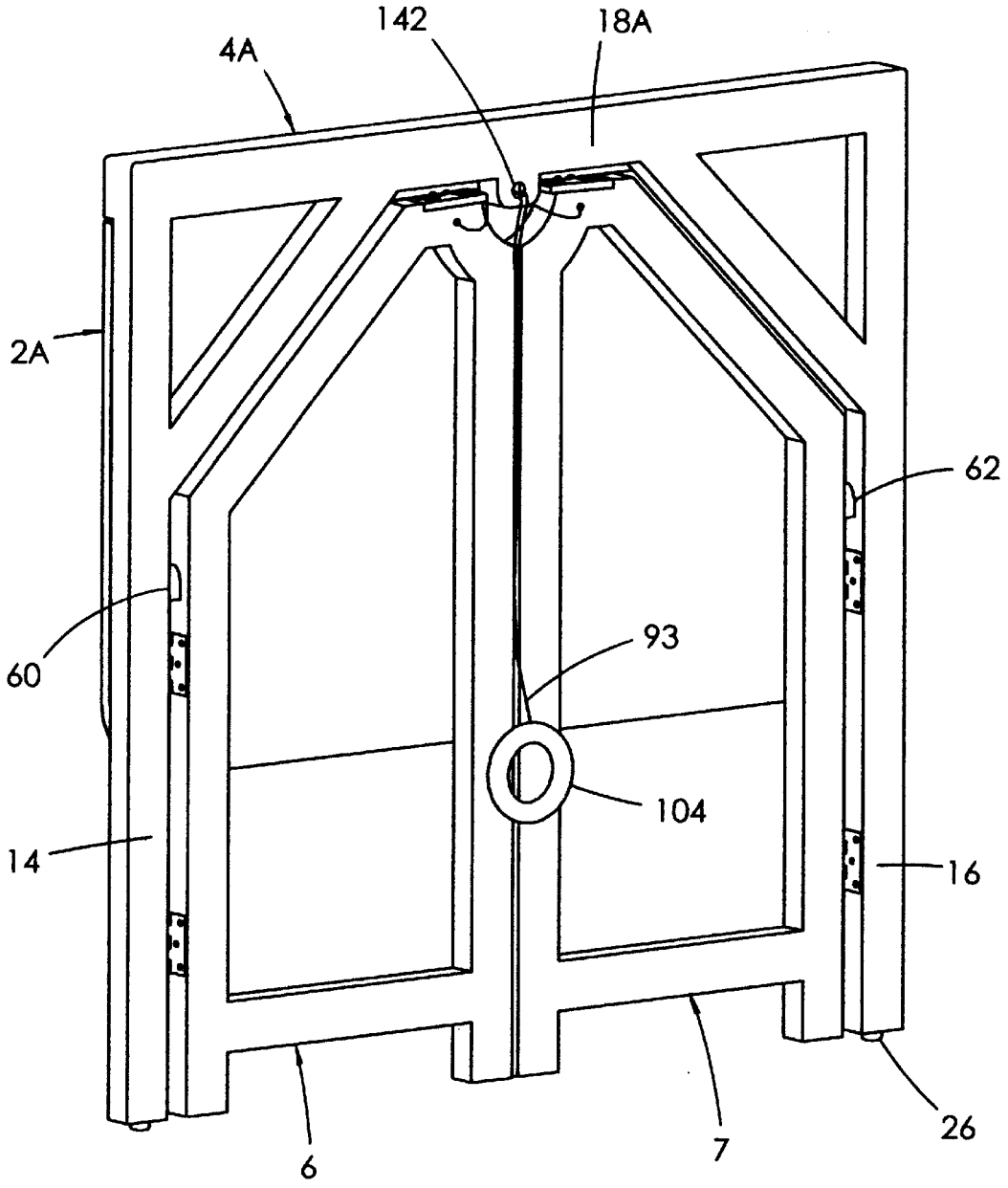
FIG. 23 is an isometric rear view of the table shown in FIGS. 20–22.

As seen in FIG. 16, the front leg assemblies 6 and 7 have longer front leg members 34. Additionally, spacers 120 are attached to the underside of the table top assembly in position to engage the top members 40 of the front leg assemblies. These spacers have a thickness that is adequate to compensate for the thickness of the feet 26 so as to assure that the table top is level when engaged with the extended front leg assemblies. Also the spring clips 60 and 62 are mounted on the flat underside of frame 10. A further differences that the rear support is a two-piece or dual structure, consisting of like support assemblies 121 and 122. Each of these support assemblies comprises a vertical riser 123, a top member 124 that is attached to and extends at a right angle from the riser, and an inclined brace member 126 which extends between the riser and the top member. The top members 124 are hinged to the table top frame by means of hinges 30 and 31. The bottom ends of the risers are provided with feet 26 as in the previous embodiment. Since the rear support is a two-piece arrangement, a separate cable guide in the form of a yoke 132 is attached to the underside of the table top assembly frame 10. Preferably, as seen in FIG. 19, the yoke 132 has two holes 134, 135 extending through it. Cables 92 and 93 attached to the front leg assemblies pass through the holes 134 and 135 in yoke 132 and are attached to the ring-shaped handle 104. The table shown in FIGS. 16–19 opens and closes in the same manner as the embodiment previously described.

FIGS. 20–23 illustrate another form of the invention which also is characterized by a level table top when unfolded. In this case, the table top differs from the previous embodiments in that the rear support assembly 4A is like one shown in FIGS. 1–14 except for certain differences. For one thing, the table top assembly 2A lacks the frame 10 of the previous embodiments and the spring clips 60, 62 are attached directly to the table top 12. Also, as seen best in FIGS. 20 and 21, the header 18A of the rear support assembly has a forward extension 138 which overlaps the table top 12 when the table top assembly is in its lowered position. The table top assembly in this case is hinged at a level lower than in the previous embodiments of FIGS. 1–19. Secondly, a depending protrusion 142 is formed integral with header 18A. Protrusion 142 has a hole through which the two cables 92 and 93 extend. Having the protrusion is done for the reason that it is necessary to have the holes through which the cables pass located so as to compensate for the lower position of the table top assembly 1. This embodiment unfolds and folds like the previous embodiments.

Figure 24:
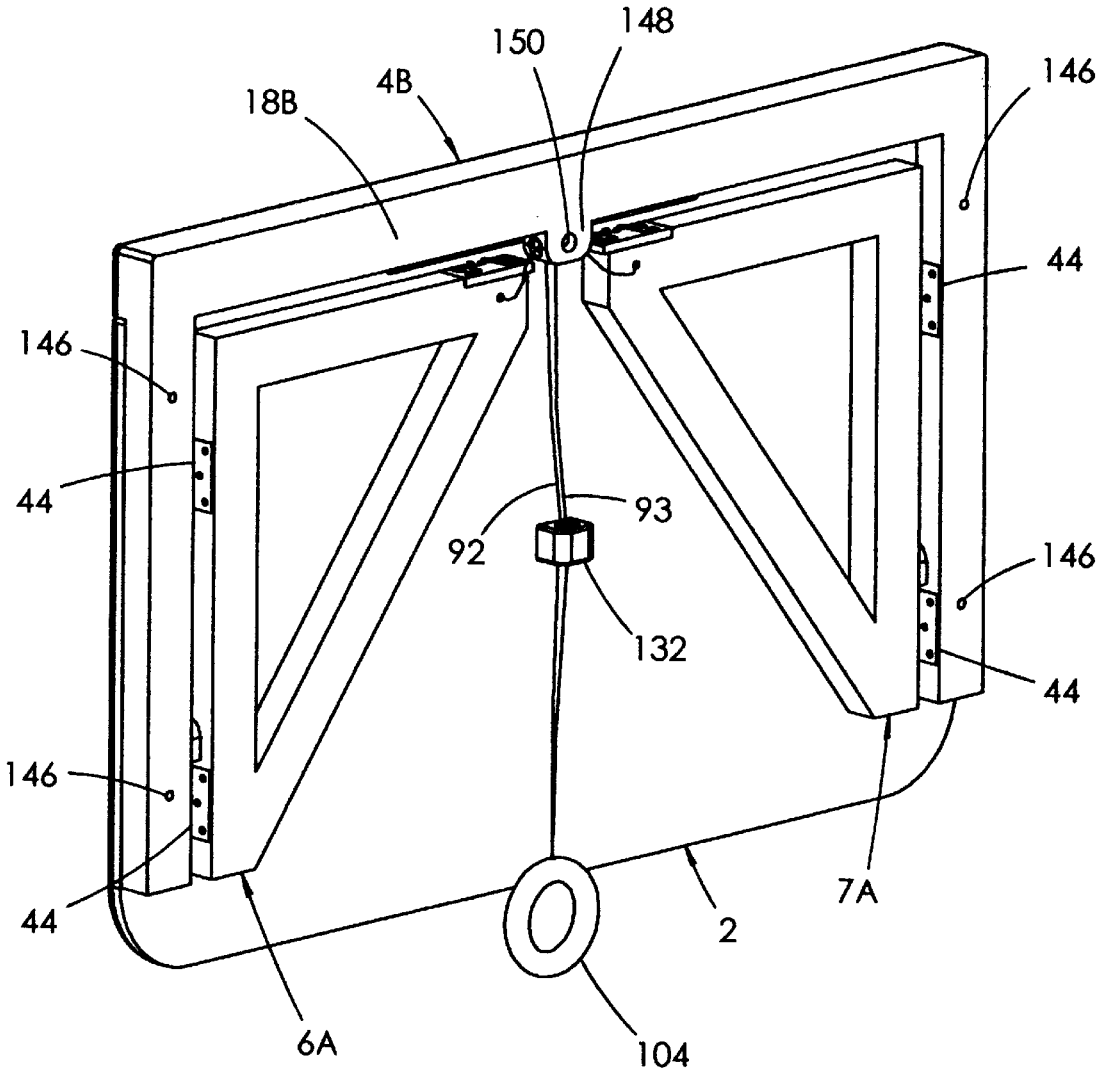
FIG. 24 is an isometric rear view of another embodiment of the invention in the form of a wall-mounted folding table.
Figure 25:
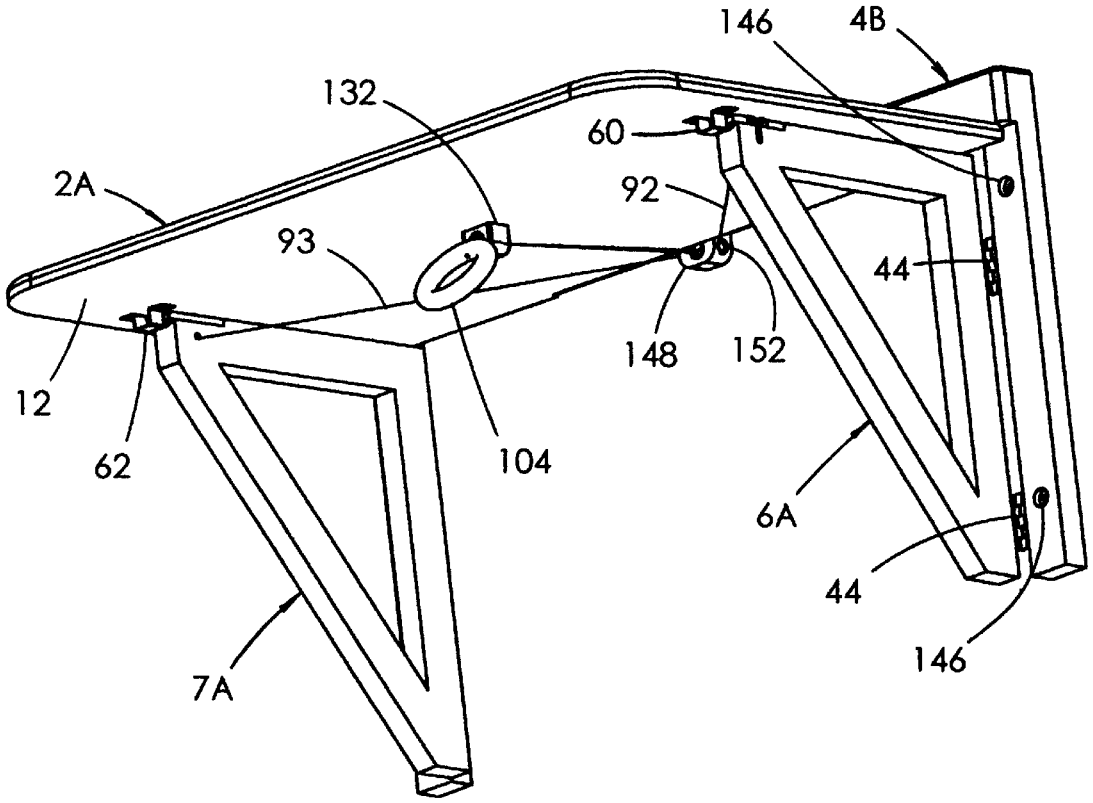
FIG. 25 is an isometric front view of a the wall mounted folding table shown in FIG. 24.

FIGS. 24 and 25 illustrate another form of table similar to that shown in FIGS. 20–23 except that the risers or legs of the rear support structure 4B are provided with holes 146 to accommodate screws for mounting the tables to a wall or other supporting object, and also the feet 26 are omitted since they are unnecessary. The table is mounted on a wall or other supporting structure at a height convenient to the user which assures that the front leg assemblies are free to rotate as intended. Also in this case a yoke 132 is mounted substantially at the center of the table top 12 so as to assure that the handle will be in a position to be readily grasped by the user when the table is in its down position. For this purpose the cables are provided with a length sufficient to permit at least a portion of the handle 104 to extend below the table top when the latter is in its lowered position. This embodiment includes a second yoke or cable guide in the form of an integral projection 148 on the header 18B of the rear support assembly. Yoke 148 has two holes 150 and 152 that intersect one another at a 90° angle. The cables 92 and 93 pass from the front leg assemblies 6A and 7A into the opposite ends of hole 152 and then out of the front end of hole 150 to the yoke 132.

Still referring to FIGS. 24 and 25, to erect the table top assembly, the user pulls up on its front end, whereupon automatically the front leg assemblies will pivot into engagement with the clips 60 and 62 as previously described, thereby supporting the table top assembly in its raised position.

Obviously the invention is susceptible of still other modifications. For example, the shape and construction of the front leg assemblies can be modified. Thus, the front leg assemblies may be constructed so as to engage the ground or floor when the rear support is vertical. Similarly, the construction and shape of the table top assembly can be changed from what is illustrated. The number, size and location of the projections 106 may be varied. Also, the arrangement of projections 106 and blind holes 110 could be reversed. More specifically, the projections 106 could be eliminated from the cantilever blade sections of pads 72 and 73 and like projections affixed to the underside of the table top in place of the blind holes 110, and blind holes or depressions like blind holes 110 could be formed in the cantilever blade sections to receive the projections on the underside of the table top. Still other modifications will be obvious to persons skilled in the art. The essential thing is that a table is provided which when unfolded provides a horizontal or inclined table top surface, with the table parts being assembled in such a way that the table may be folded or unfolded in one relatively fast, relatively low effort motion.

What is claimed is:

1. A folding table structure adapted to provide a horizontal or inclined table top surface when unfolded, said structure comprising a table top assembly, a support assembly for supporting said table top assembly, said support assembly comprising first and second rear legs and a header affixed to and extending between said rear legs, said table top assembly being hingedly attached at one edge thereof to said support assembly so as to be movable from a down stored position to an up use position, and first and second front leg assemblies for supporting said table top assembly when said table top assembly is in its up use position, said first and second front leg assemblies being pivotally attached to said first and second rear legs respectively so as to be movable from a folded position adjacent said support assembly to an extended position spaced from said support assembly, said front leg assemblies being retained in the folded position by the weight of said table top when said table top is in its down stored position.

2. A folding table structure according to claim 1 further comprising first and second retaining assemblies for releasably connecting said front leg assemblies to said table top assembly when said front leg assemblies are in their extended positions and said table top is in its down stored position.

3. A folding table structure according to claim 2 wherein each of said retaining assemblies comprises a retaining clip attached to said table top assembly, and means on one of said front leg assemblies for releasably engaging said retaining clip.

4. A folding table structure according to claim 2 wherein each of said retaining assemblies comprises first means on one of said front leg assemblies and second means on said table top assembly releasably engageable with said first means.

5. A folding table structure according to claim 4 wherein each of said first means is a lip on the upper end of one of said front leg assemblies and each of said second means is a spring clip attached to said table top assembly.

6. A folding table structure according to claim 2 wherein said first and second retaining assemblies include means for restricting pivotal motion of said leg assemblies relative to said support.

7. A folding table structure according to claim 2 wherein said first and second retaining assemblies include protrusions on said front leg assemblies that interlock with holes in said table top assembly so as to restrict pivotal motion of said front leg assemblies.

8. A folding table structure according to claim 7 further including selectively operable means for retracting said protrusions from said holes when it is desired to return said front leg assembles to their folded position.

9. A folding table structure according to claim 2 wherein said retaining assemblies comprise a pad attached to the top end of each front leg assembly, each pad overlapping said each front leg assembly so as to provide an outwardly projecting surface for interlocking with a retaining clip carried by said table top assembly.

10. A folding table structure according to claim 9 wherein each pad comprises a flexible portion that is capable of moving in one direction when a force is applied and moving vertically back to its original position when the force is removed, and at least one protrusion on said flexible portion that has a height that measures less than the extent of vertical movement of said flexible portion when said force is applied, and a hole in said table top assembly for each protrusion sized and positioned to receive said protrusion when said table top assembly is in its up use position, whereby to prevent said front leg assemblies from pivoting relative to said support.

11. A folding table structure according to claim 10 wherein each front leg assembly has a passageway and a cable guide is attached to said rear support, and further wherein each front leg assembly has a separate flexible cable extending through said passageway and having one end attached to said flexible portion and an opposite end extending through said cable guide and attached to a handle for use in pulling on said cable, each of said cables having a length sufficient to cause said front leg assemblies to pivot from said extended position to said folded position when said cable is pulled.

12. A folding table structure according to claim 11 wherein said cable guide has first and second intersecting holes, and further wherein cables attached to said first and second leg assemblies pass through said first and second holes and are gathered together at a point beyond said cable guide so that they may be pulled simultaneously.

13. A folding table structure according to claim 12 further comprising spring clips attached to the underside of said tabletop assembly, said clips having a movable tab extensions which, upon downward movement of the tabletop assembly, interfere with, are moved by, and then clasp overhanging lips on said front leg assemblies so as to secure said tabletop assembly against pivotal movement away from said front leg assemblies while allowing said front leg assemblies to swing on their pivots relative to said table top.

14. A folding table structure according to claim 10 wherein said table top assembly comprises a table top having a bottom surface, and further including a second cable guide fixed to said bottom surface, with said cables extending from said handle through both of said cable guides to said flexible portions of the said pads that are attached to said top ends of said front leg assemblies.

15. A folding table structure according to claim 2 wherein said support assembly is adapted to be fastened to a vertical wall, and further wherein when said support assembly is fastened to a vertical wall, said table top assembly in its down position will lie substantially parallel to said wall and adjacent to said support assembly.

16. A folding table structure adapted to provide a horizontal or inclined table top surface when unfolded, said structure comprising a table top assembly having a table top surface, a support assembly characterized by first and second legs for supporting said table top assembly, first hinge means pivotally connecting an upper end of said support assembly to said table top assembly adjacent one edge thereof, whereby said table top assembly is pivotable on a horizontal axis from a down stored position to an up use position, first and second leg assemblies, second hinge means connecting said first and second leg assemblies to said first and second legs respectively whereby said leg assemblies are pivotable on axes that extend parallel to said first and second legs from a folded position adjacent said support assembly to an extended position spaced from said support assembly, means for releasably locking said table top assembly to said leg assemblies when said leg assemblies are in their extended positions and said table top assembly is in its up use position, and means including cords attached to said leg assemblies for unlocking said table top assembly from said leg assemblies and pulling said leg assemblies from their extended positions to their folded positions, said leg assemblies being held in their folded position by the weight of said table top assembly when the latter is in its down stored position.

17. A folding table structure according to claim 16 wherein said second hinge means directly connect said leg assemblies to said first and second legs, and further wherein said second hinge means are spring biased so as to urge said leg assemblies to pivot toward their extended positions.

18. A folding table comprising a table top, a support structure for said table top comprising first and second rear legs and support means affixed to and holding said rear legs against movement relative to each other and said support means, hinge means connecting said table top to said support structure so that said table top can pivot between a first lowered store position in which it extends substantially parallel to said rear legs and a second raised use position in which it extends at an angle to said rear legs, and first and second front leg assemblies each comprising a front leg, said first and second front leg assemblies being hinged to said first and second rear legs respectively so as to permit said first and second leg assemblies to pivot between a first retracted position in which said front legs are adjacent to said rear legs and a second extended position in which said front legs are spaced from said rear legs in position to support said table top in its second raised use position.

19. A folding table according to claim 18 wherein said front and rear legs each have a bottom end and being arranged so that when said front leg assemblies are in their first retracted position and said table is positioned so that said rear legs extend vertically and have their bottom ends engaged with a floor, said bottom ends of said front legs will be spaced from said floor.

20. A folding table according to claim 18 wherein said front leg assemblies are arranged so that when they are in their said second extended positions in supporting relation with said table top and said rear and front legs are all resting on a horizontal floor, said table top will be inclined to said floor.

21. A folding table according to claim 18 wherein said front leg assemblies are arranged so that when they are in their said second extended positions in supporting relation with said table top and said rear and front legs are all resting on a horizontal floor, said table top will extend parallel to said floor.

22. A folding table structure according to claim 18 wherein said table top has a first end that is hinged to said support structure by said hinge means and a second opposite end that extends over said front legs when said front leg assemblies are in their second extended position and said table top is held in its second raised use position by said front leg assemblies, and releasable lock means, operative when (a) said table top assembly is in its said second raised use position and (b) said front leg assemblies are in their second extended positions, for releasably locking said table top to said front leg assemblies.

23. A table according to claim 18 wherein each of said front legs has a top end, and further wherein each front leg assembly comprises a header member attached to said top end of its said front leg, a rear riser that is hinged to one of said first and second rear legs, and means connecting said rear riser to said header member and the said front leg to which said header is attached.

24. A table according to claim 23 wherein said last mentioned means comprises two strut members, one connecting said riser to said header member and the other connecting said riser to the said front leg.

25. A folding table structure according to claim 18 wherein said front leg assemblies are hinged to said support structure by spring-biased hinges that urge said front leg assemblies to pivot to their said second extended positions, and further wherein said front leg assemblies are retained in their first retracted position by the weight of said table top assembly.

26. A folding table structure according to claim 18 wherein said table top has a first end that is hinged to said support structure by said hinge means and a second opposite end that overlies said front legs when said front leg assemblies are in their second extended position and said table top is in its second use position, and further including releasable lock means comprising first and second cooperating means carried by said table top and said first and second front leg assemblies respectively and operative when said table top assembly is in its said second use position for releasably locking said table top to said front leg assemblies, and manually operable means for releasing said releasable lock means, said manually operable means comprising a pull cord coupled to said second cooperating means and slidably supported by said support means.

27. A folding table comprising a table top, a support structure for said table top comprising first and second rear legs and support means affixed to and holding said rear legs against movement relative to each other and said support means, and first and second front leg assemblies each comprising a front leg that extends parallel to said rear legs, said first and second front leg assemblies being hinged to said first and second rear legs respectively so as to permit said first and second leg assemblies to pivot between a first retracted position in which said front legs are adjacent to said rear legs and a second extended position in which they said front legs are spaced from said rear legs, said front and rear legs each having a bottom end and being arranged so that the bottom ends of said back legs project beyond the bottom ends of said front legs, whereby when said bottom ends of said rear legs are engaged with a floor, said front leg assemblies can be pivoted to move said front legs toward or away from said rear legs without engaging said front legs with said floor; and hinge means connecting said table top to said support structure so that said table top can pivot between a first stored position in which is extends substantially parallel to said rear legs when said front leg assemblies are in their first retracted position and a second use position in which it extends at an angle to said rear legs and is supported by said first and second front leg assemblies when said front leg assemblies are in their second extended position.

28. A folding table comprising a table top having first and second opposite end portions, a support structure for said table top comprising first and second rear leg assemblies each having an upper end, first hinge means connecting said first end portion of said table top to said upper ends of said first and second rear leg assemblies so that said table top can pivot between a first lowered store position in which its second end portion is adjacent to said rear leg assemblies and a second raised use position in which its second end portion extends at an angle away from said rear leg assemblies, and first and second front leg assemblies each comprising a front leg, second hinge means connecting said first and second front leg assemblies to said first and second rear leg assemblies respectively so as to permit said first and second leg assemblies to pivot between a first retracted store position in which said front legs are adjacent to said rear leg assemblies and said table top can be moved to its said first position and a second extended support position in which they said front leg assemblies extend at an angle to said rear leg assemblies and said front legs are spaced from said rear legs in position for said front leg assemblies to form a stable support for second end portion of said table top when said table top is in its said second position.

29. A folding table according to claim 28 wherein said front and rear leg assemblies each have a bottom end and further wherein said bottom ends of said rear leg assemblies project a short distance below said bottom ends of said front leg assemblies.

30. A folding table according to claim 28 wherein said front and rear leg assemblies each have a bottom end and said bottom ends of said front leg assemblies project below said bottom ends of said rear leg assemblies.

31. A folding table according to claim 30 further wherein said rear leg assemblies are adapted to be fastened to a vertical wall, and further wherein when said rear leg assemblies are fastened to a vertical wall said table top in its first position will lie substantially parallel to said wall.

32. A folding table structure according to claim 17 wherein said second hinge means are spring biased so as to urge said first and second leg assemblies into their said second extended support positions.

* * * * *

UNITED STATES PATENT AND TRADEMARK OFFICE

CERTIFICATE OF CORRECTION

PATENT NO. : 6,314,892 B1
DATED : November 13, 2001
INVENTOR(S) : Peter B. Favini It is certified that error appears in the above-identified patent and that said Letters Patent is hereby corrected as shown below:

Column 8,
Line 12, delete the word “a”;

Column 10,
Line 17, change “they” to -- the --;
Line 27, change “is” to -- it --; and
Line 35, insert -- said -- before “second”.

Signed and Sealed this

Twenty-second Day of October, 2002

*Attest:*

*Attesting Officer*

JAMES E. ROGAN
*Director of the United States Patent and Trademark Office*